US008272337B2

(12) United States Patent
Carter

(10) Patent No.: US 8,272,337 B2
(45) **Date of Patent: *Sep. 25, 2012**

(54) MODULAR FOLDING TABLE

(76) Inventor: Mark C. Carter, Murrieta, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/339,041

(22) Filed: Dec. 28, 2011

(65) Prior Publication Data

US 2012/0097079 A1 Apr. 26, 2012

Related U.S. Application Data

(62) Division of application No. 12/395,450, filed on Feb. 27, 2009, now Pat. No. 8,096,246, which is a division of application No. 11/444,154, filed on May 31, 2006, now Pat. No. 7,503,266.

(51) Int. Cl.
*A47B 5/00* (2006.01)

(52) U.S. Cl. ..... 108/115; 108/166

(58) Field of Classification Search ..... 108/115, 108/127, 67, 157.1, 159.12, 64, 157.17, 157.18, 108/166; 403/286, 292, 293, 294; 248/346.01, 248/346.02, 346.03, 188.2, 188.6; 297/248
See application file for complete search history.

(56) References Cited

U.S. PATENT DOCUMENTS

| | | | |
|---|---|---|---|
| 490,991 | A | 1/1893 | Smith |
| 841,998 | A | 1/1907 | Mulford |
| 881,709 | A | 3/1908 | O'Leary |
| 1,263,717 | A | 4/1918 | Stone |
| 1,879,087 | A | 9/1932 | Chomik |
| 2,271,496 | A | 1/1942 | Hofman |
| 2,644,590 | A | 7/1953 | Baxter |
| 2,936,896 | A | 5/1960 | Friedman |
| 2,987,362 | A | 6/1961 | Bernath |
| 3,462,773 | A | 8/1969 | Triplett |
| 3,499,398 | A | 3/1970 | Murray |
| 4,010,696 | A | 3/1977 | Priesman |
| 4,066,373 | A | 1/1978 | Workman |
| 4,607,656 | A | 8/1986 | Carter |
| 4,700,986 | A | 10/1987 | Davis et al. |
| 5,052,846 | A | 10/1991 | Behshid |
| 5,131,547 | A | 7/1992 | Goldberg |
| 5,765,248 | A | 6/1998 | Ono |
| 5,794,546 | A | 8/1998 | Carter |
| 6,325,337 | B1 | 12/2001 | Pedley et al. |
| 6,536,359 | B2 | 3/2003 | Liu |
| 6,640,730 | B2 | 11/2003 | Tsai |
| 6,648,541 | B1 | 11/2003 | Zimmer et al. |
| 6,776,105 | B2 | 8/2004 | Rivera et al. |
| 2004/0065237 | A1 | 4/2004 | Tsai |
| 2004/0104189 | A1 | 6/2004 | Yu |

FOREIGN PATENT DOCUMENTS

| | | | |
|---|---|---|---|
| CH | 423130 | | 4/1967 |
| CN | 1144466 | A | 3/1997 |
| CN | 2346284 | Y | 11/1999 |
| CN | 2518393 | Y | 10/2002 |
| DE | 211143 | C | 8/1908 |
| DE | 495572 | C | 4/1930 |

(Continued)

*Primary Examiner* — Jose V Chen
*Assistant Examiner* — Matthew Ing
(74) *Attorney, Agent, or Firm* — Fulwider Patton LLP

(57) ABSTRACT

The modular folding table includes a collapsible truss framework that supports a folding table top and a folding utility shelf, and includes legs that can be connected horizontally or vertically to the legs of one or more similar modular folding tables, to provide desired table and shelf space with a structure that is foldable, strong and stable.

17 Claims, 24 Drawing Sheets

FOREIGN PATENT DOCUMENTS

| | | | |
|---|---|---|---|
| DE | 2334393 | A1 | 1/1975 |
| DE | 3619481 | A1 | 12/1987 |
| FR | 741098 | A | 2/1933 |
| FR | 1296014 | A | 5/1962 |
| FR | 2678813 | A1 | 1/1993 |
| GB | 4872 | | 0/1913 |
| GB | 10159 | A | 0/1911 |
| GB | 464496 | A | 7/1935 |
| GB | 501952 | A | 3/1939 |
| JP | 49003248 | U | 1/1974 |
| JP | 50144821 | U | 11/1975 |
| JP | 52005461 | U | 1/1977 |
| JP | 59171530 | U | 11/1984 |
| SE | 425540 | B | 10/1982 |
| WO | 8600206 | A1 | 1/1986 |
| WO | 92012313 | A1 | 7/1992 |

MODULAR FOLDING TABLE

CROSS-REFERENCE TO RELATED APPLICATION

This Application is a divisional of application Ser. No. 12/395,450, filed on Feb. 27, 2009, now U.S. Pat. No. 8,096,246, which is a divisional of application Ser. No. 11/444,154, filed on May 31, 2006, now U.S. Pat. No. 7,503,266, incorporated by reference in their entirety.

BACKGROUND OF THE INVENTION

This invention relates generally to folding, collapsible structures, and more particularly relates to a modular folding table having a truss framework, a folding table top and a folding utility shelf.

Folding card tables and heavy work tables having individual legs or pairs of legs that are pivotally connected to a table top to swing down from a concealed position to lock into a set up position are well known. The portability of such tables is generally limited by the size of the table top. The lighter card table style tables are generally not strong enough or stable enough to support modern video or computer types of displays that are currently used in traveling presentations. The heavier, folding work style tables are generally quite large and heavy, making them impractical for use as a portable display table in presentations, often requiring the use of a truck for transporting video or computer display equipment and appropriate display tables. A display table offering one or more utility shelves would also be useful for providing an efficient use of space for display equipment, but conventional tables providing one or more utility shelves have also generally not been collapsible and easily portable.

In order to provide such a collapsible display table that is expandable both horizontally as well as vertically, it would be desirable to provide a modular folding table with a collapsible truss framework that supports a folding table top and a folding utility shelf to offer a larger and more efficient use of table space, and having improved strength and stability, to support relatively large, heavy equipment and displays such as video display monitors, video or film display equipment, and the like. The present invention fulfills these needs.

SUMMARY OF THE INVENTION

Briefly and in general terms, the present invention provides for a modular folding table with a collapsible truss framework that supports a folding table top and a folding utility shelf, with the truss framework connected to a plurality of legs that can be connected horizontally or vertically to the legs of one or more similar modular folding tables, to provide desired table and shelf space with a structure that is foldable, strong and stable.

The present invention accordingly provides for a modular folding table, including a plurality of vertically disposed legs, each of the legs having an upper end and a lower end, and a truss framework connected to each of the legs. The truss framework includes a plurality of truss pairs of link members, each of the truss pairs including first and second link members having upper and lower ends. The first and second link members are pivotally connected together at a midpoint between the upper and lower ends, the first end of the first link member is pivotally connected to the upper end of one of the legs, and the second end of the first link member is slidably connected to an adjacent one of the legs. The first end of the second link member is similarly pivotally connected to the upper end of one of the legs, the second end of the first link member is slidably connected to an adjacent one of the legs, and the first and second link members are pivotally connected together in a scissors configuration so as to be extendable horizontally from a collapsed configuration to an extended configuration. Each of the first and second link members advantageously includes a table top support bracket mounted between the midpoint and the upper ends of the link members. A plurality of slider members are slidably mounted to each of the plurality of vertically disposed legs, respectively, and the second ends of the link members are connected to corresponding slider members, respectively, for slidably connecting adjacent second link members of adjacent sides to corresponding vertically disposed legs, respectively. A table top is removably disposed on the upper ends of the legs and rests on the table top support brackets of the truss pairs of link members in the extended configuration.

In one presently preferred aspect, the upper ends of the legs include a land for supporting the table top, and the upper ends of the legs include a recess for receiving a lower end of a leg of a second modular folding table for vertically stacking the second modular folding table on the modular folding table. In another presently preferred aspect, an upper leg connector bracket is provided for connecting one the recess of one of the legs of the modular folding table to an adjacent recess in an upper end of a leg of a second modular folding table for horizontally connecting the modular folding table and the second modular folding table together. A lower leg connector bracket may also be provided for connecting one of the legs of the modular folding table to an adjacent leg of a second modular folding table for horizontally connecting the modular folding table and the second modular folding table together. A latch may also be provided for latching at least one of the slider members in a fixed position on at least one of the legs.

In another presently preferred aspect, each of the legs further includes a telescoping foot extension, and the legs may include means for fixing the foot extension in a retracted position or in an extended position. The upper ends of the legs along at least one side of the modular folding table may also include a socket for receiving a table top support bar. A second modular folding table may also be provided, wherein the upper ends of the legs along at least one side of the second modular folding table include a land for supporting the second table top and a socket for receiving the table top support bar. In another presently preferred aspect, the table top includes a plurality of segments connected together by at least one hinge, so as to be foldable. In another presently preferred aspect, the table top comprises at least three segments connected together by at least two hinges each including a pair of flat plate portions connected to adjoining segments of the table top, the pair of flat plate portions being pivotally connected together by a pivot pin, and the at least two hinges having the flat plate portions connected to the pivot pin at positions at different distances from the flat plate portions so that the table top is foldable. In another presently preferred aspect, the table top includes a plurality of notches at corner locations corresponding to the plurality of legs when the legs and the truss framework are in the extended configuration.

In another presently preferred aspect, the modular folding table includes at least two shelf support arms each having first and second ends, and means for removably attaching the first and second ends between adjacent legs for supporting a lower shelf, which may be disposed on the at least two shelf support arms. In another presently preferred aspect, the lower shelf includes a plurality of segments hingedly connected together so as to be foldable. The lower shelf may, for example, include at least three segments connected together by at least two hinges, the at least two hinges each including a pair of flat plate portions connected to adjoining segments of the lower shelf, the pair of flat plate portions being pivotally connected together by a pivot pin, and the at least two hinges having the flat plate portions connected to the pivot pin at positions at different distances from the flat plate portions, so that the lower shelf is foldable. In another presently preferred aspect, the lower shelf includes a plurality of notches at corner locations corresponding to the plurality of legs when the legs and the truss framework are in the extended configuration.

Other features and advantages of the present invention will become more apparent from the following detailed description of the preferred embodiments in conjunction with the accompanying drawings, which illustrate, by way of example, the operation of the invention.

DETAILED DESCRIPTION OF THE PREFERRED EMBODIMENTS

Figure 1:
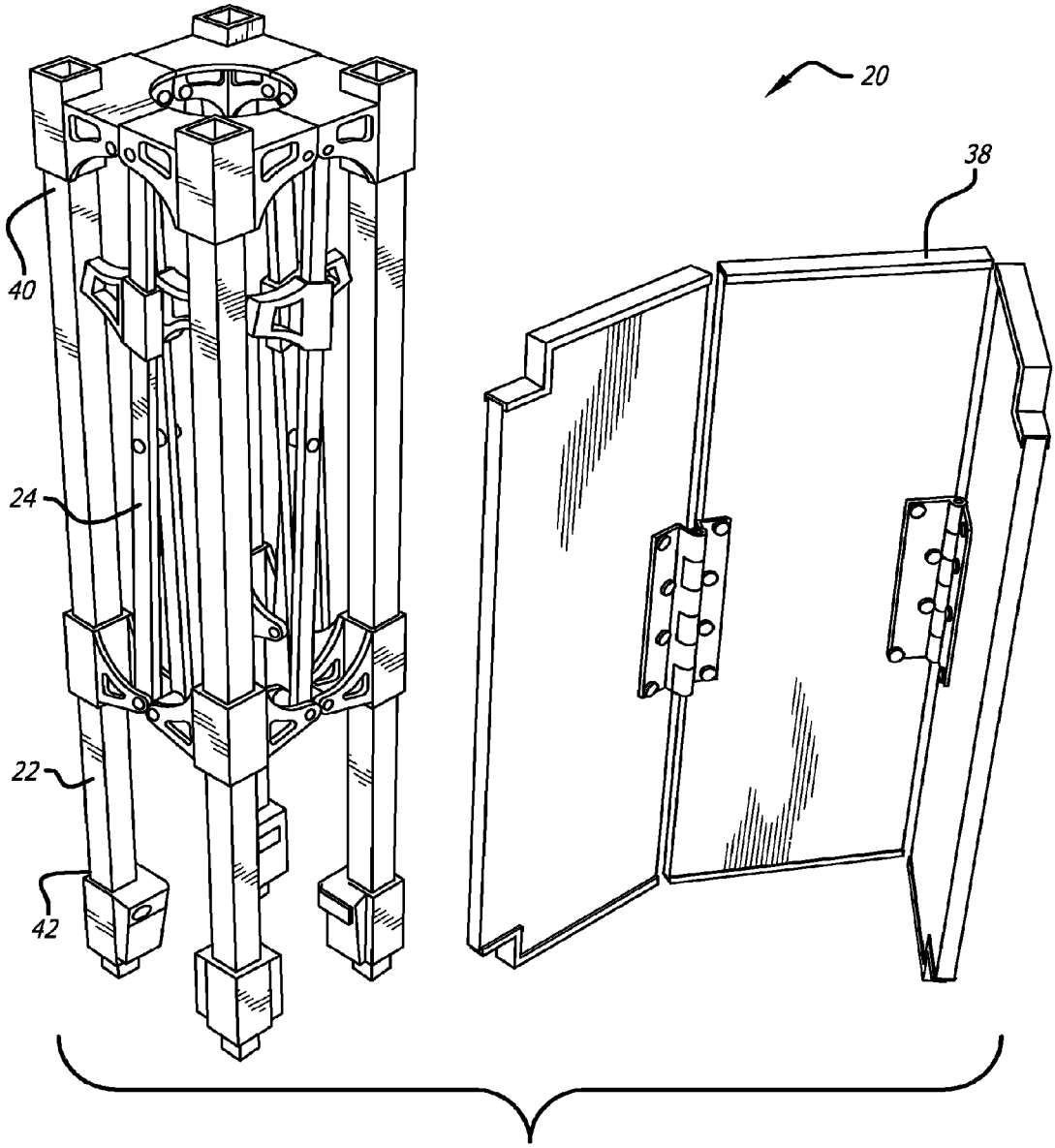
FIG. 1 is a perspective view of a first embodiment of the modular folding table in a disassembled, collapsed configuration according to the present invention.
Figure 3:
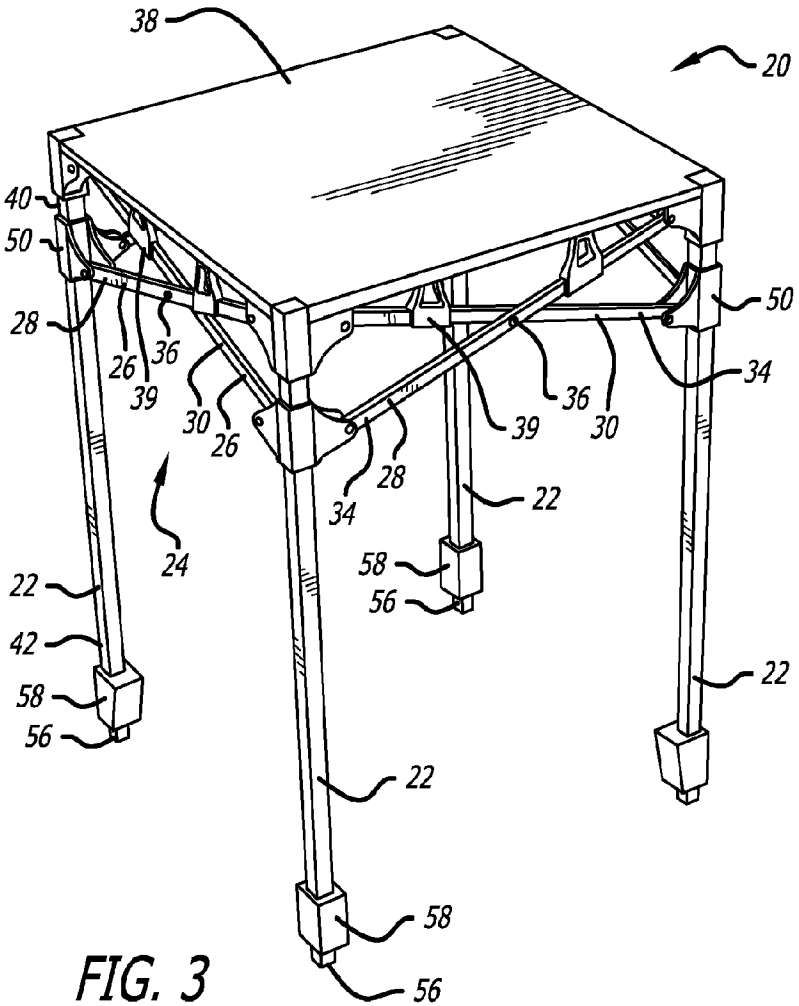
FIG. 3 is a perspective view of the modular folding table of FIG. 1 in an assembled, extended configuration.
Figure 2:
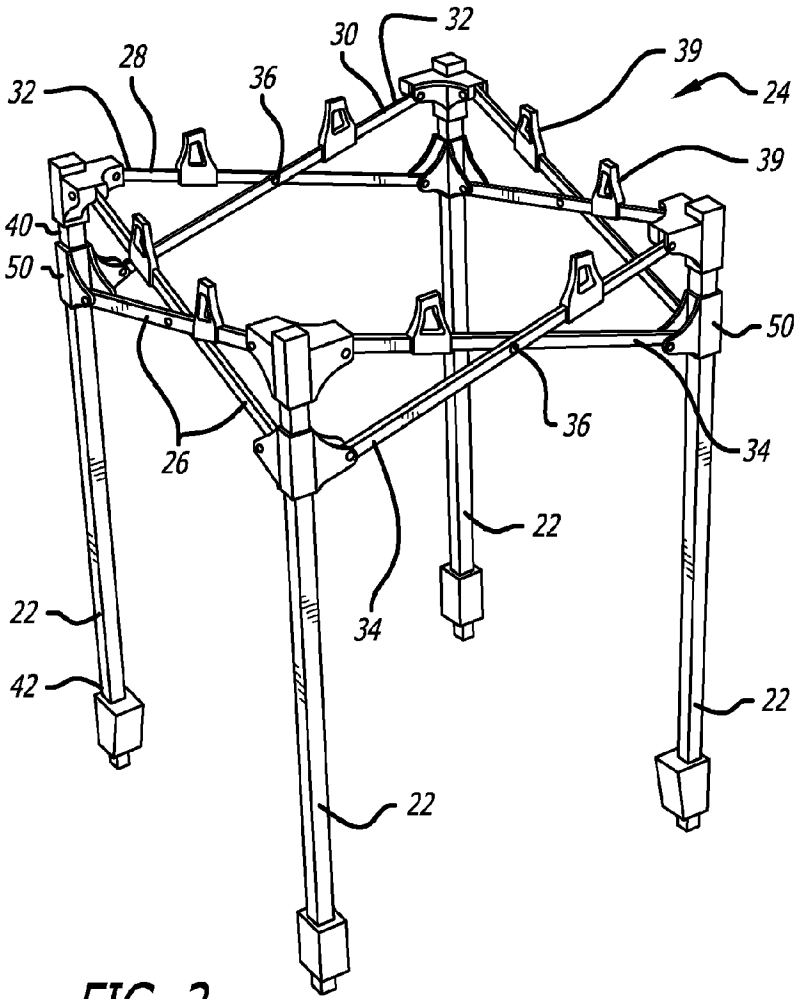
FIG. 2 is a perspective view of the modular folding table of FIG. 1 in an extended configuration prior to assembly with the table top.

Referring to the drawings, which are provided for purposes of illustration and by way of example, the present invention provides for a modular folding table 20, including a plurality of legs 22, and a truss framework 24 connected to each of the legs, shown in a disassembled, collapsed configuration in FIG. 1. As is shown in FIG. 2, the truss framework includes a plurality of truss pairs of link members 26, with each of the truss pairs including first link members 28 and second link members 30, each having upper ends 32 and lower ends 34. A table top 38, shown in FIGS. 1 and 3, can be removably disposed on the upper ends of the legs. The first and second link members are pivotally connected together at a midpoint 36 between the upper and lower ends in a scissors configuration so as to be extendable horizontally from a collapsed configuration to an extended configuration. Referring to FIGS. 2 and 3, in a presently preferred aspect, each of the first and second link members also includes a table top support bracket 39 mounted between the midpoint and the upper ends of the link members for contacting and supporting the table top when it is placed on the upper ends of the legs.

Each of the legs has an upper end 40 and a lower end 42, and the upper end of the first link member is pivotally connected to the upper end of one of the legs, and the lower end of the first link member is slidably connected to an adjacent one of the legs. Likewise, the upper end of the second link member is pivotally connected to the upper end of one of the legs, and the lower end of the first link member is slidably connected to an adjacent one of the legs.

Figure 6:
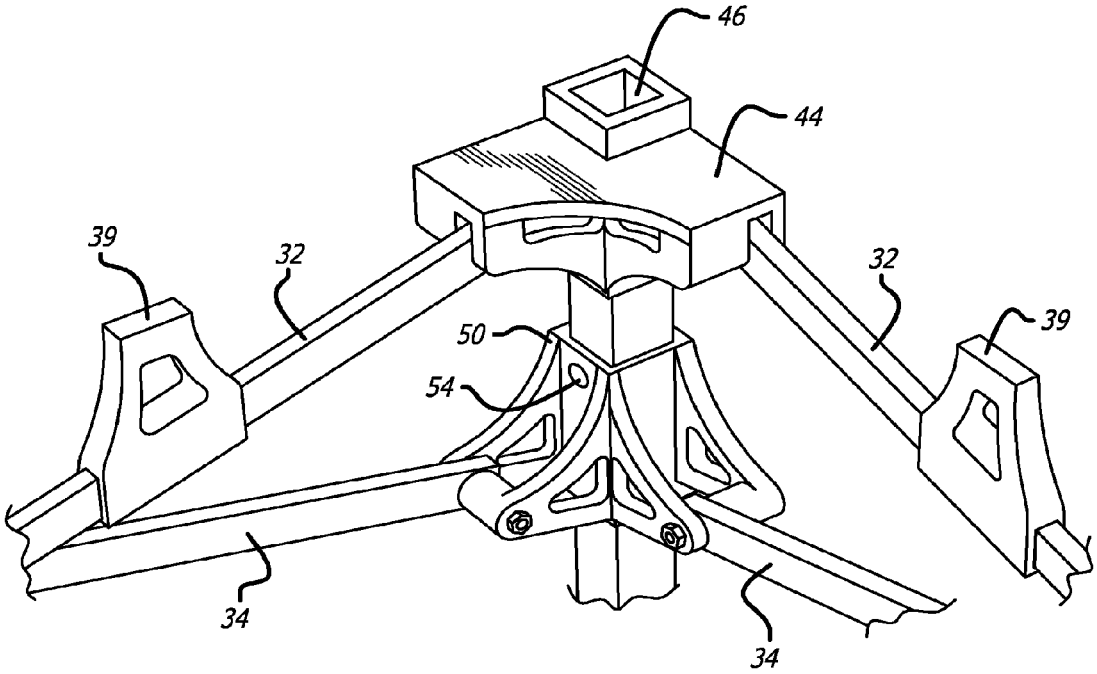
FIG. 6 is a perspective view of the upper end of a leg of the modular folding table of FIG. 1.
Figure 7:
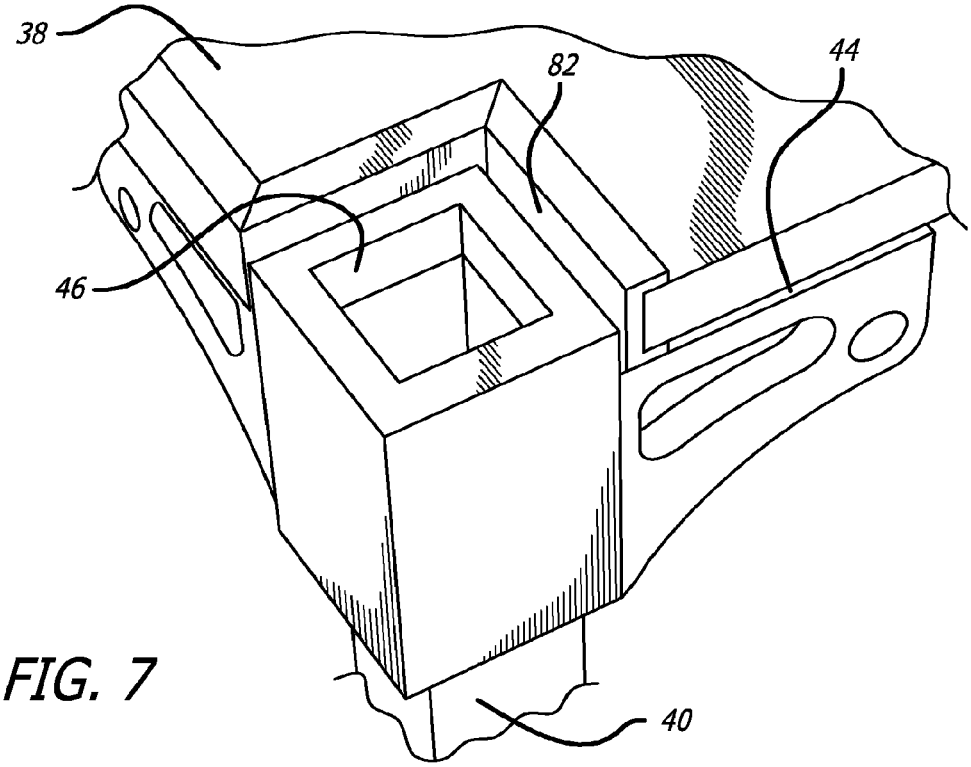
FIG. 7 is a perspective view of a corner of the upper side of the table top and upper end of a leg of the modular folding table of FIG. 1.
Figure 14:
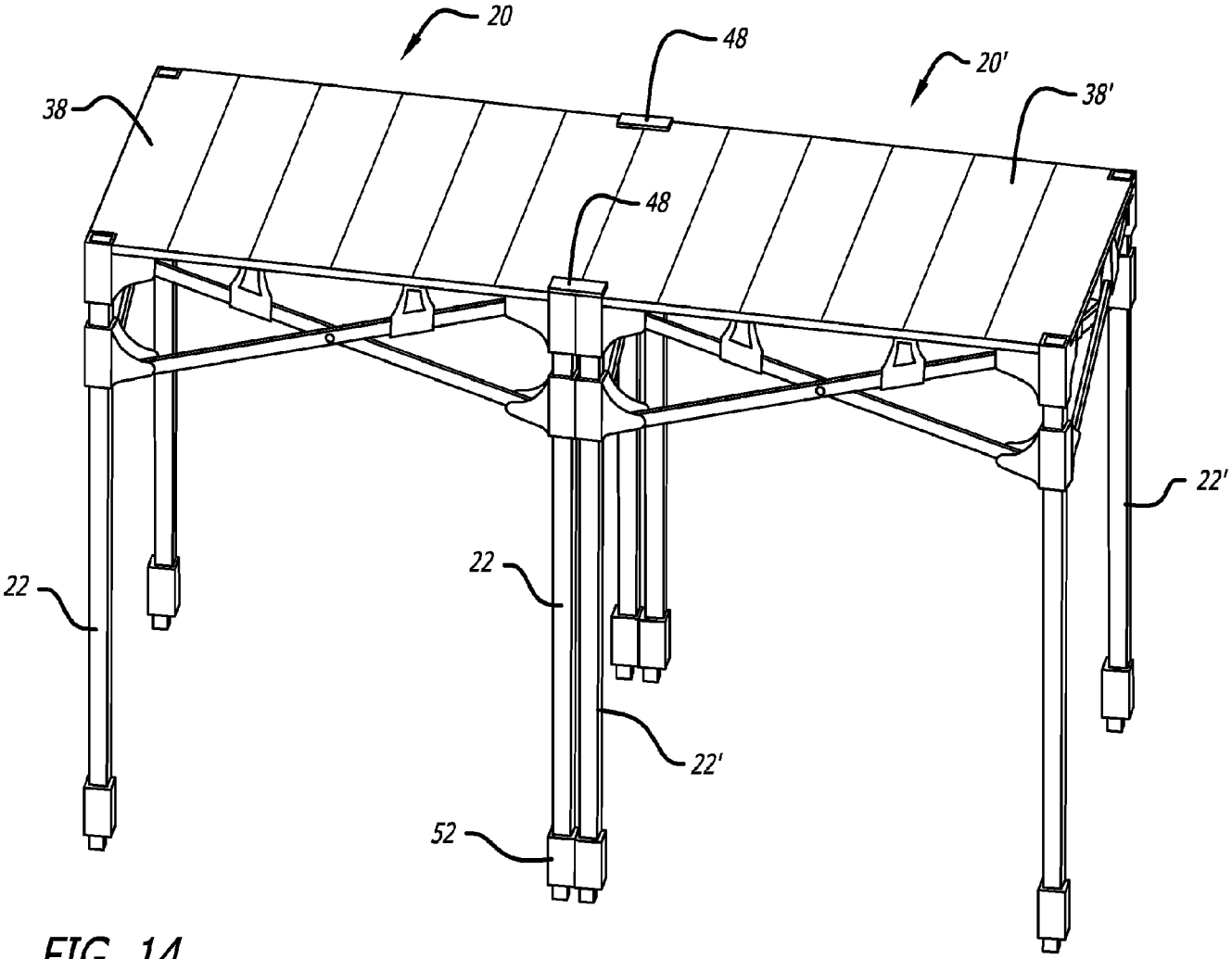
FIG. 14 is a perspective view of the modular folding table of FIG. 1 horizontally connected to a second modular folding table by a lower leg connector bracket.
Figure 29:
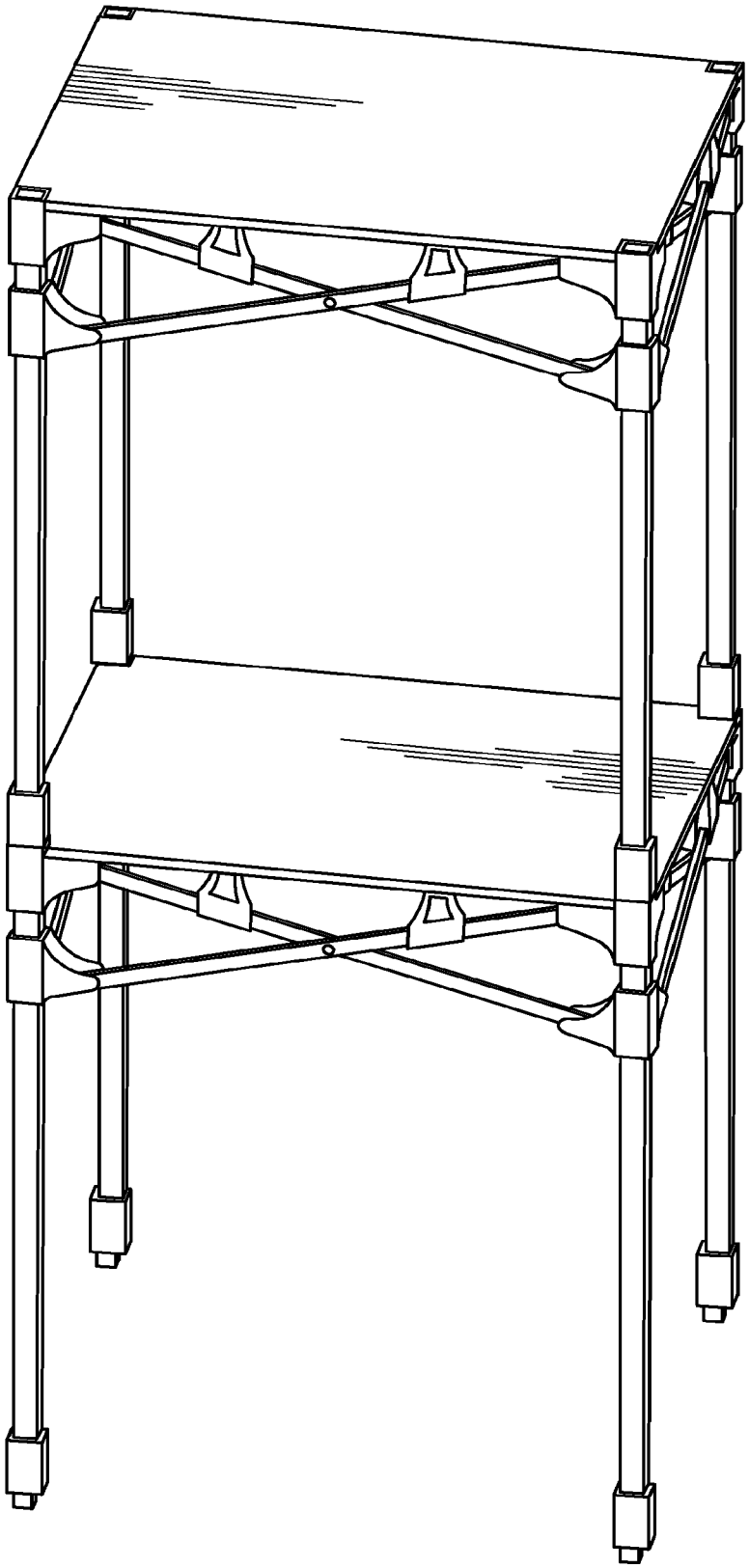
FIG. 29 is a perspective view of a lower modular folding table of FIG. 1 with a second modular folding table vertically stacked on top, with the legs of the second modular folding table connected in the upper recesses of the legs of the lower modular folding table.

With reference to FIGS. 6 and 7, in a presently preferred aspect, the upper ends of the legs include a land 44 for supporting the table top. In another presently preferred aspect, the upper ends of the legs include a recess 46 for receiving a lower end of a leg 22' of a second modular folding table 20', for stacking the second modular folding table on the modular folding table, as is illustrated in FIG. 29, or for horizontally connecting an adjacent second modular folding table 20', as is illustrated in FIG. 14, described further below.

Figure 4:
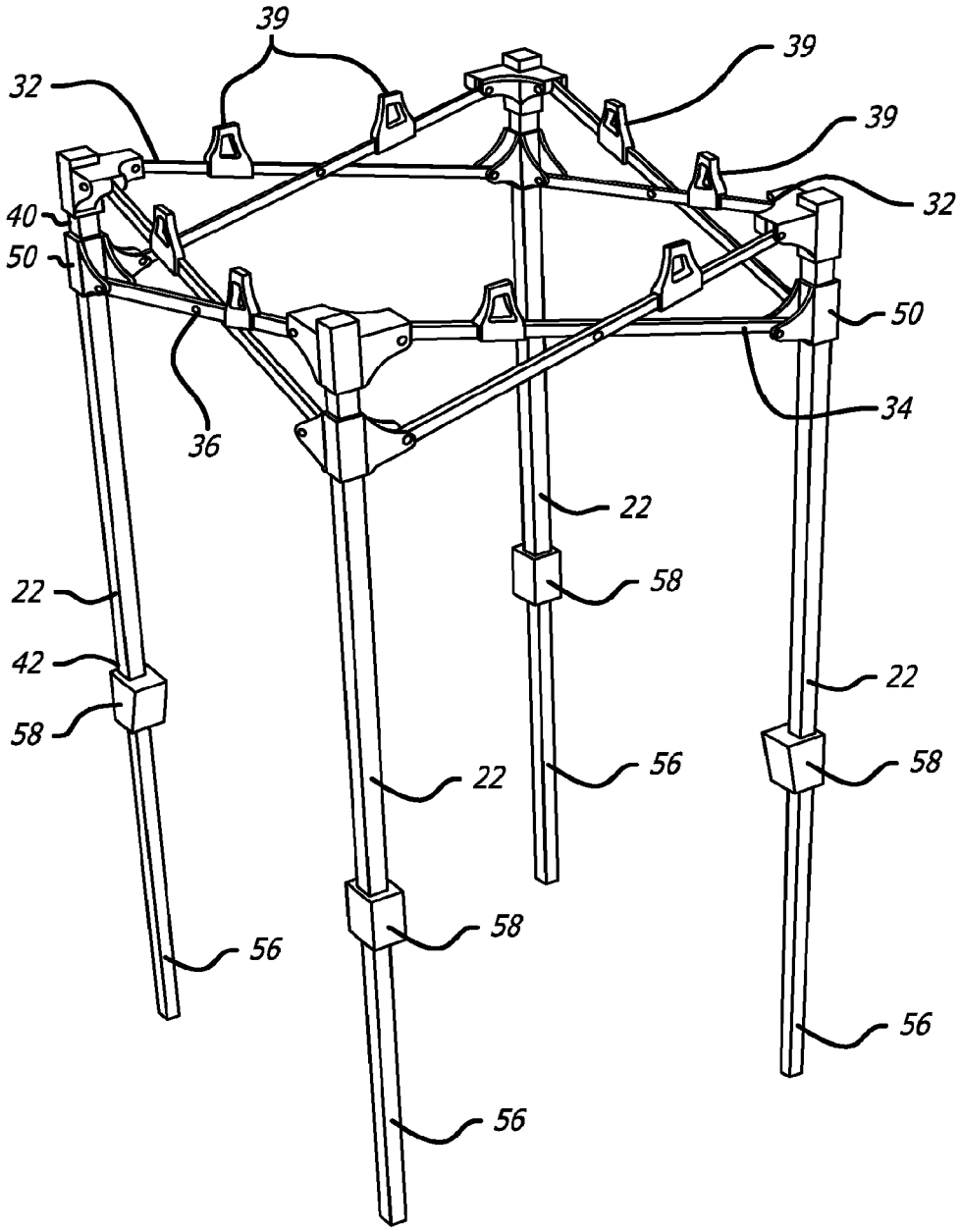
FIG. 4 is a perspective view of the modular folding table of FIG. 1 in an extended configuration with the legs extended, prior to assembly with the table top.
Figure 5:
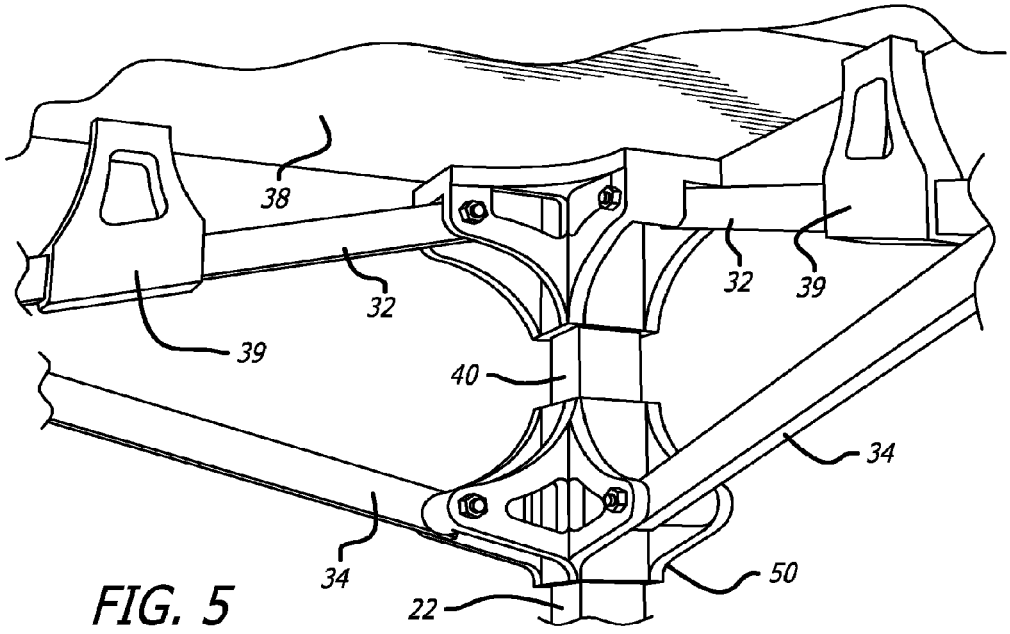
FIG. 5 is a perspective view of the underside of the table top and upper end of a leg of the modular folding table of FIG. 1.

Referring to FIG. 5, each the leg preferably includes a slider member 50 slidably mounted to the leg for slidably connecting the lower ends of the first and second link members to corresponding ones of the legs. As is illustrated in FIG. 6, in a presently preferred aspect, at least one of the legs includes latch means 54 for latching at least one of the slider members in a fixed position on the leg. Referring to FIGS. 2 and 4, each of the legs preferably includes a telescoping foot extension 56, and each of the legs preferably includes means 58 for fixing the foot extension in a retracted position and for fixing the foot extension in an extended position, such as spring loaded detent pins and corresponding latching holes in the leg, for example.

Figure 8:
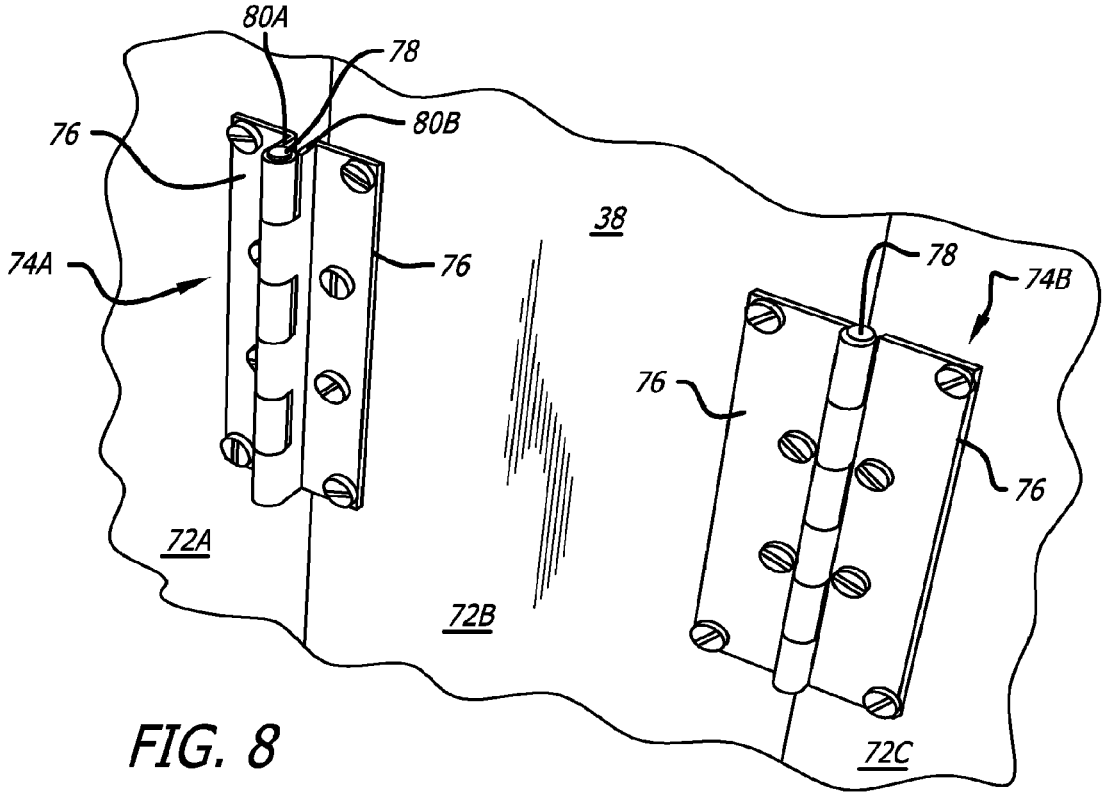
FIG. 8 is a perspective view of the underside of the table top showing the hinges of the table top of FIG. 1.
Figure 9:
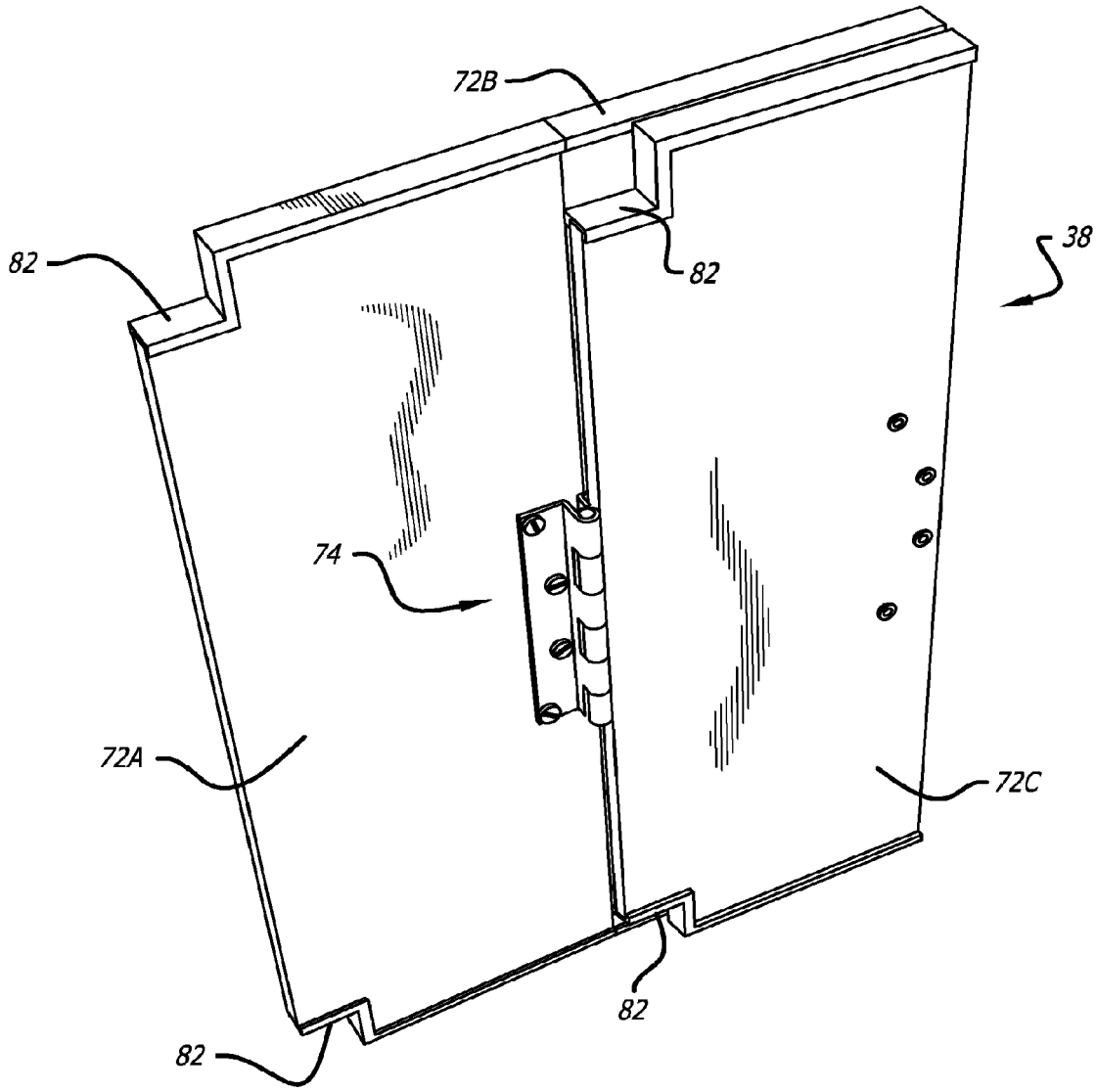
FIG. 9 is a perspective view of the underside of the table top illustrating the folding of the table top of FIG. 1.

As is shown in FIGS. 8 and 9, the table top comprises a plurality of segments 72*a*, 72*b*, 72*c*, connected together by at least one hinge 74 so that the table top segments are foldable. Typically, the table top comprises at least three segments connected together by at least two hinges, 74*a*, 74*b*, each of which includes a pair of flat plate portions 76 connected to adjoining segments of the table top. The pair of flat plate portions of each hinge are pivotally connected together by a pivot pin 78, and preferably the flat plate portions of at least one of the hinges are connected to the pivot pin by right angle members 80*a*, 80*b* extending transversely from the flat plat portions, so that the table top segments are foldable. In another presently preferred aspect, shown in FIGS. 7 and 9, for example, the table top includes a plurality of notches 82 at corner locations corresponding to the plurality of legs when the legs and the truss framework are in the extended configuration.

Figure 11:
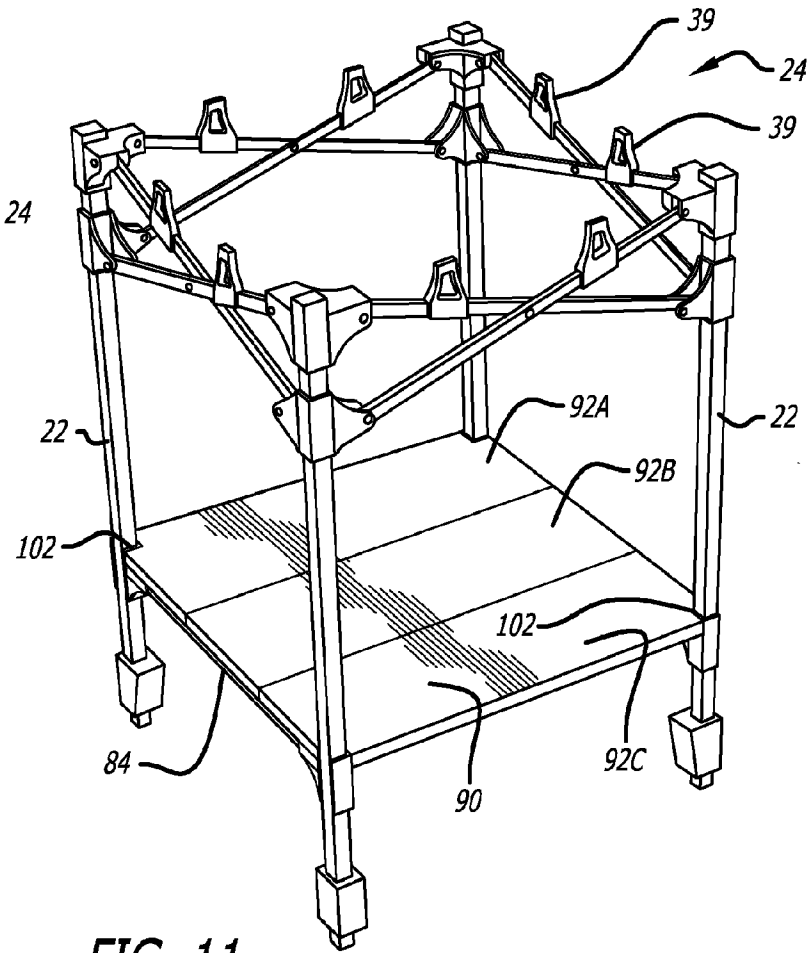
FIG. 11 is a perspective view of the modular folding table of FIG. 1 in an extended configuration, with shelf support arms added, prior to assembly with the table top.
Figure 10:
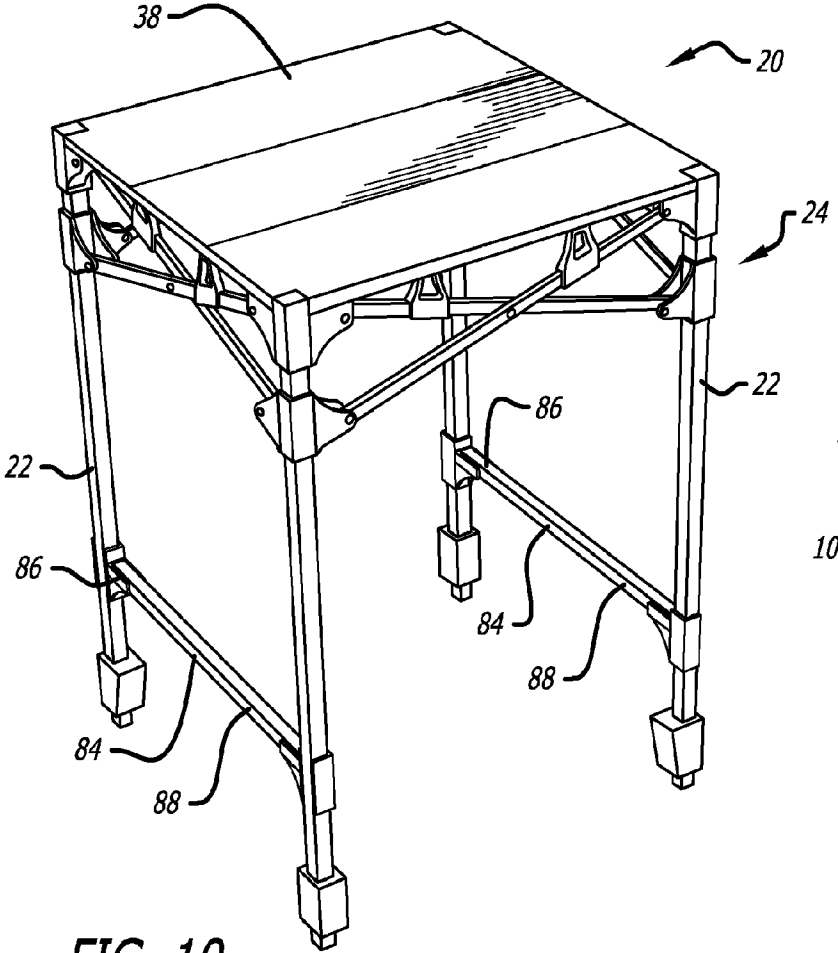
FIG. 10 is a perspective view of the modular folding table of FIG. 1 in an assembled, extended configuration, with shelf support arms added.
Figure 12:
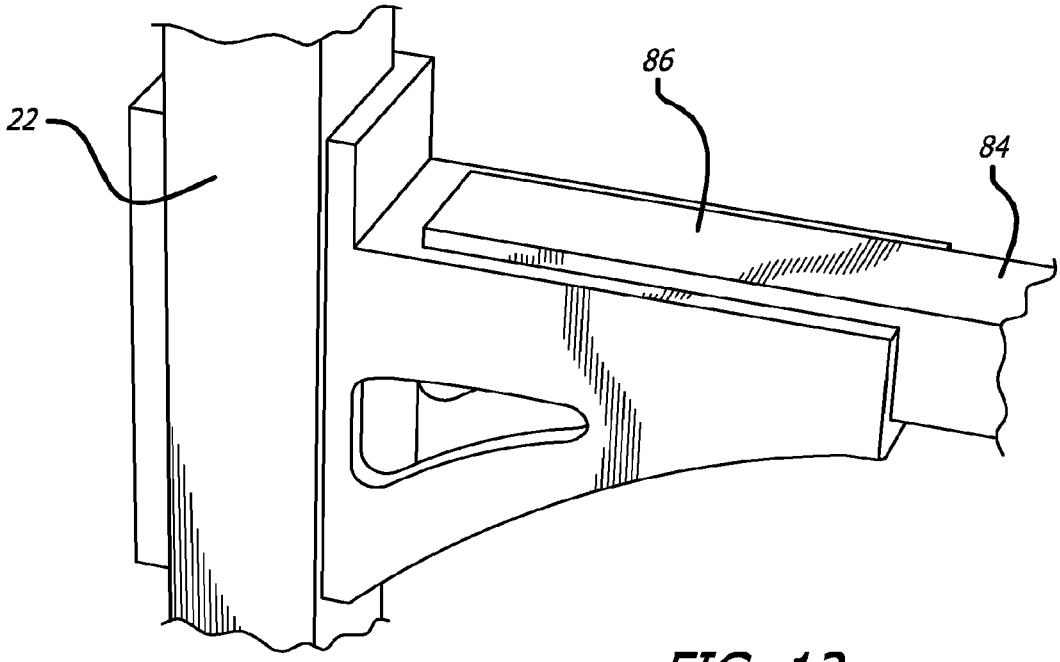
FIG. 12 is a perspective view of a shelf support bracket mounted to a leg of the modular folding table of FIG. 1.
Figure 13:
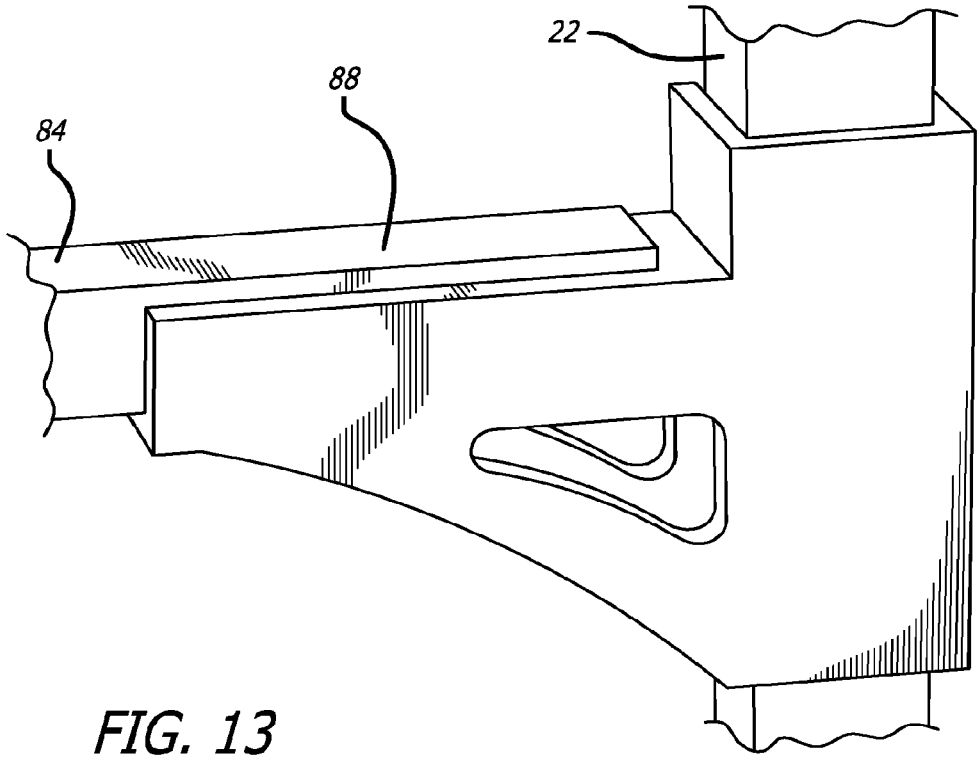
FIG. 13 is another perspective view of a shelf support bracket mounted to a leg of the modular folding table of FIG. 1.

Referring to FIGS. 10-13, in another presently preferred aspect, the modular folding table may be provided with at least two shelf support arms 84 each having a first end 86 and a second end 88 connected between a pair of legs, so that a lower shelf 90, shown in FIG. 11, may thus be removably disposed on the shelf support arms. The lower shelf typically includes a plurality of segments hingedly connected together so as to be foldable, such as at least three segments 92*a*, 92*b*, 92*c* connected together by at least two hinges, for example. The hinges of the shelf typically also each include a pair of flat plate portions connected to adjoining segments of the lower shelf, and the pair of flat plate portions are pivotally connected together by a pivot pin 98. Preferably the flat plate portions of at least one of the hinges are connected to the pivot pin by right angle members 100*a*, 100*b* extending transversely from the flat portions, so that the lower shelf segments are foldable. In another preferred aspect, the lower shelf includes a plurality of notches 102 at corner locations corresponding to the plurality of legs when the legs and the truss framework are in the extended configuration.

Figure 15:
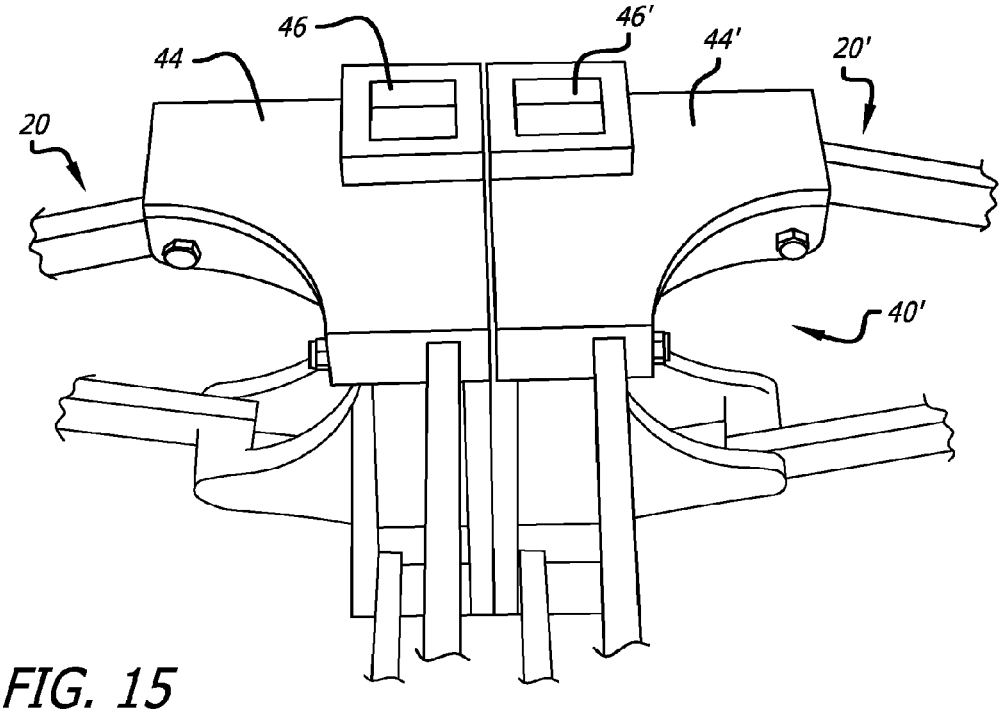
FIG. 15 is a perspective view of the upper end of a leg of the modular folding table of FIG. 1 placed adjacent to the upper end of a leg of a second modular folding table showing the placement of the upper recesses of the adjacent legs together.
Figure 16:
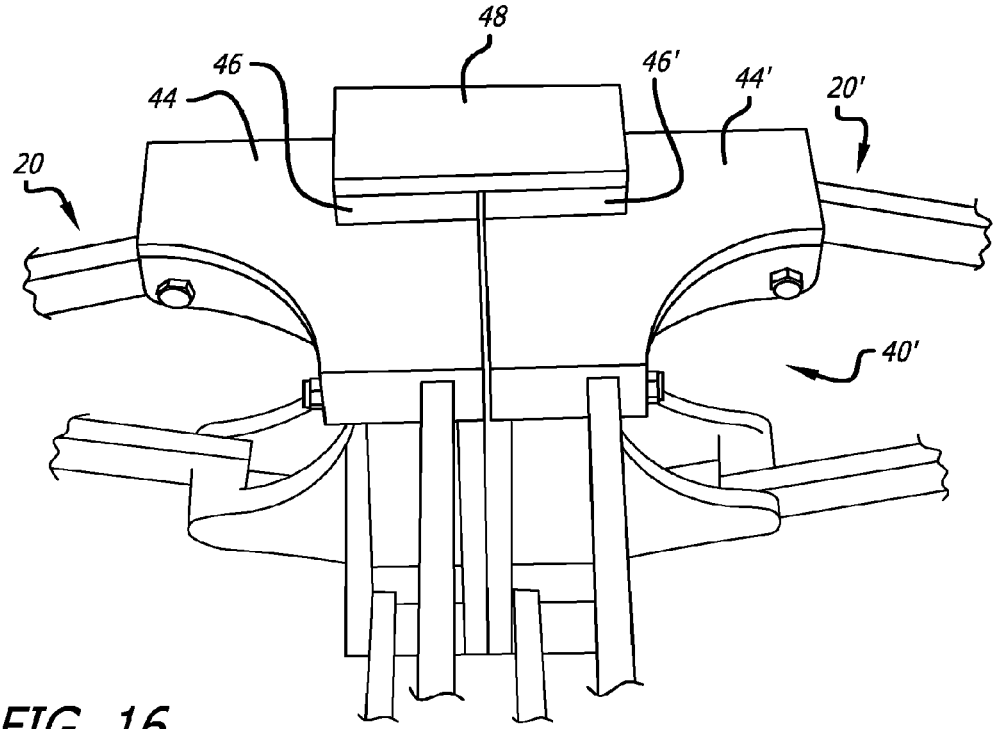
FIG. 16 is a perspective view of the upper ends of the legs of the first and second modular folding tables of FIG. 15 horizontally connected together with an upper leg connecting bracket connecting the upper recesses of the adjacent legs together.
Figure 17:
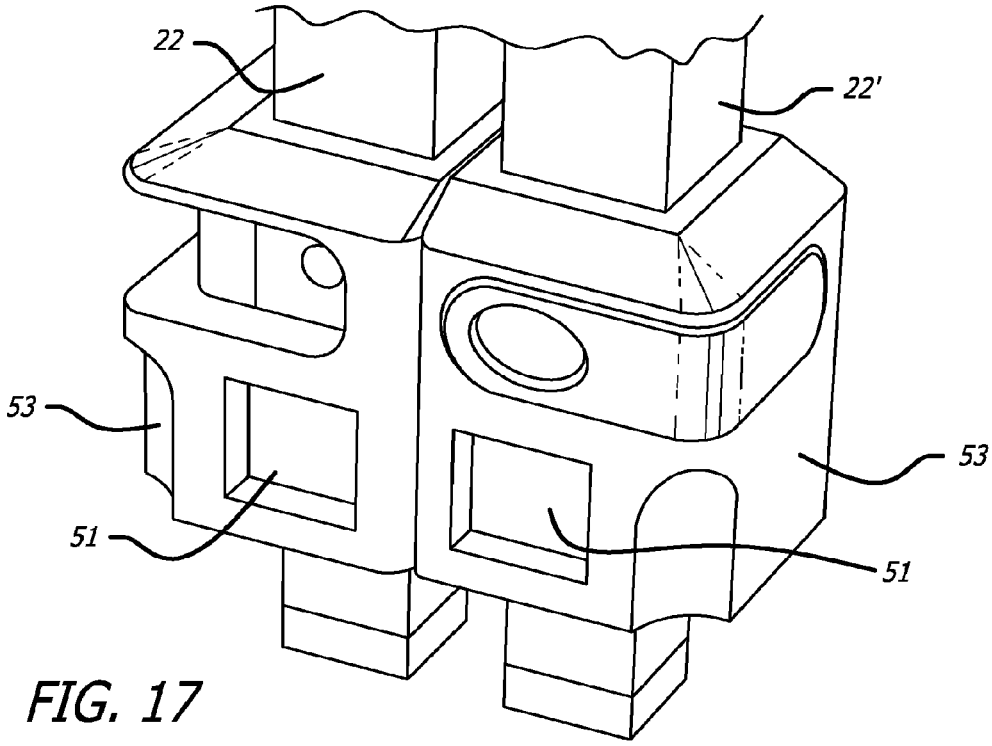
FIG. 17 is a perspective view of the lower end of a leg of the modular folding table of FIG. 1 placed adjacent to the lower end of a leg of a second modular folding table.
Figure 18:
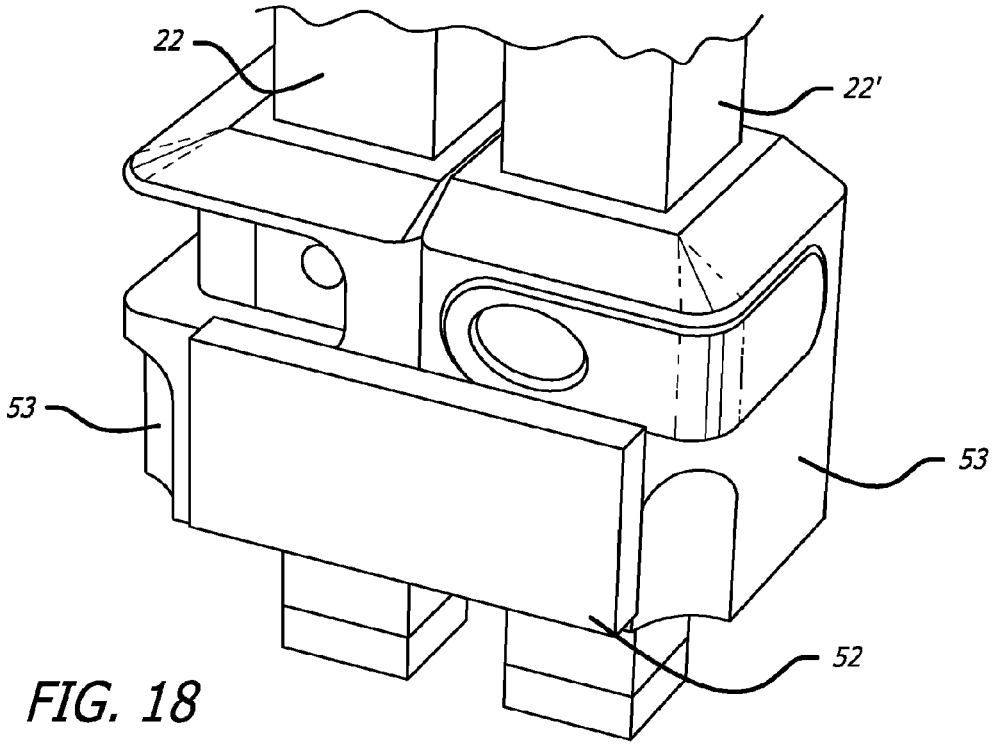
FIG. 18 is a perspective view of the lower ends of the legs of the first and second modular folding tables of FIG. 17 with a lower leg connecting bracket connecting the lower legs together.

Referring to FIGS. 14-16, an upper leg connector bracket 48, such as a two plug cap, for example, may also be provided for connecting a recess 46 of one of the legs of the modular folding table to an adjacent recess 46' in an upper end 40' of a leg 22' of a second modular folding table 20' for connecting the modular folding table 20 and the second modular folding table 20' together. As is illustrated in FIGS. 14, 17 and 18, a lower leg connector bracket 52, such as a two plug cap, for example, may also be provided for connecting sockets 51 of female connector brackets 53 attached to the lower leg portions may also be provided for connecting one of the legs 22 of the modular folding table to an adjacent leg 22' of a second modular folding table 20' for connecting the modular folding table and the second modular folding table together.

Figure 19:
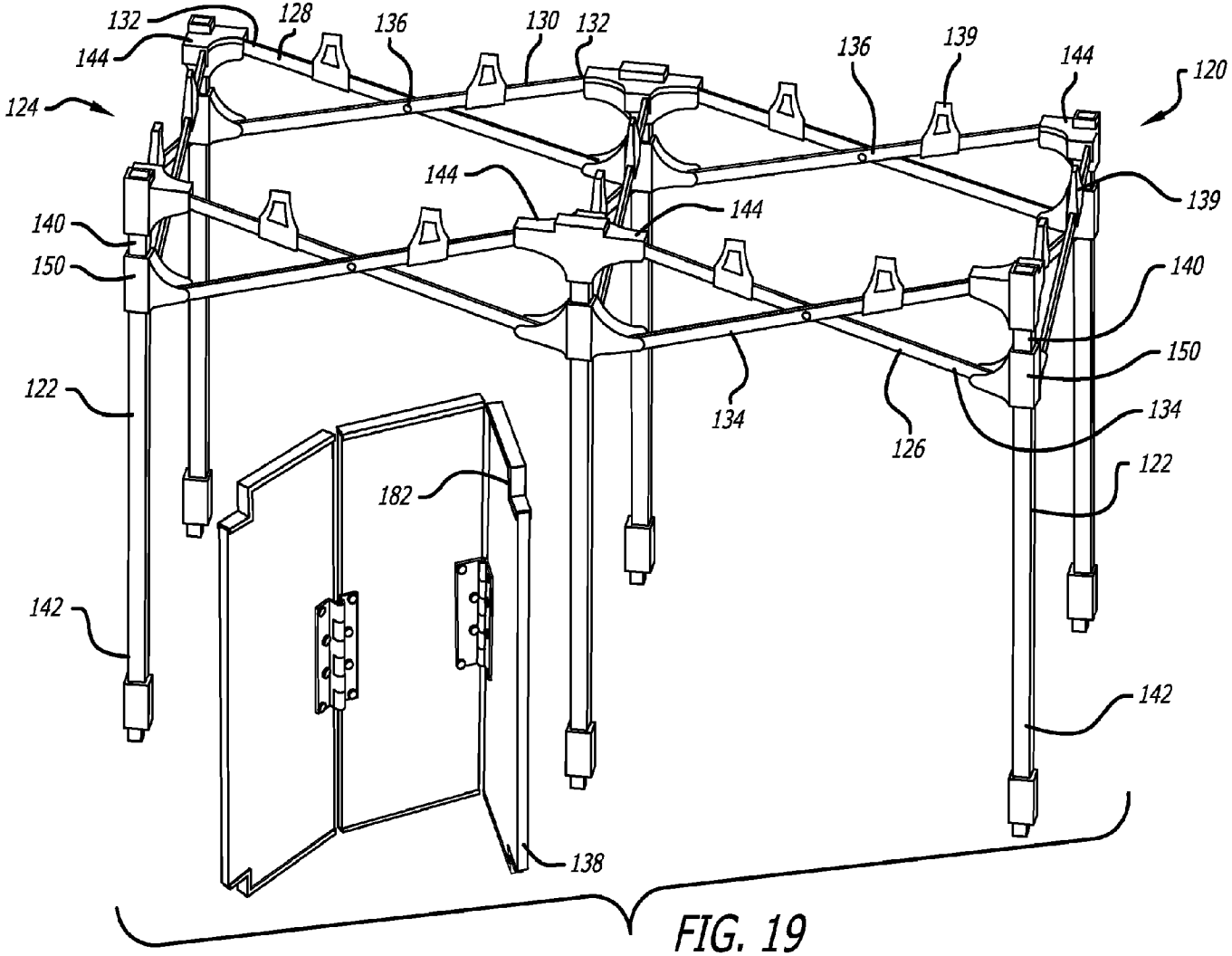
FIG. 19 is a perspective view of a second embodiment of the modular folding table in a disassembled, extended configuration, prior to assembly with a table top, according to the present invention.
Figure 20:
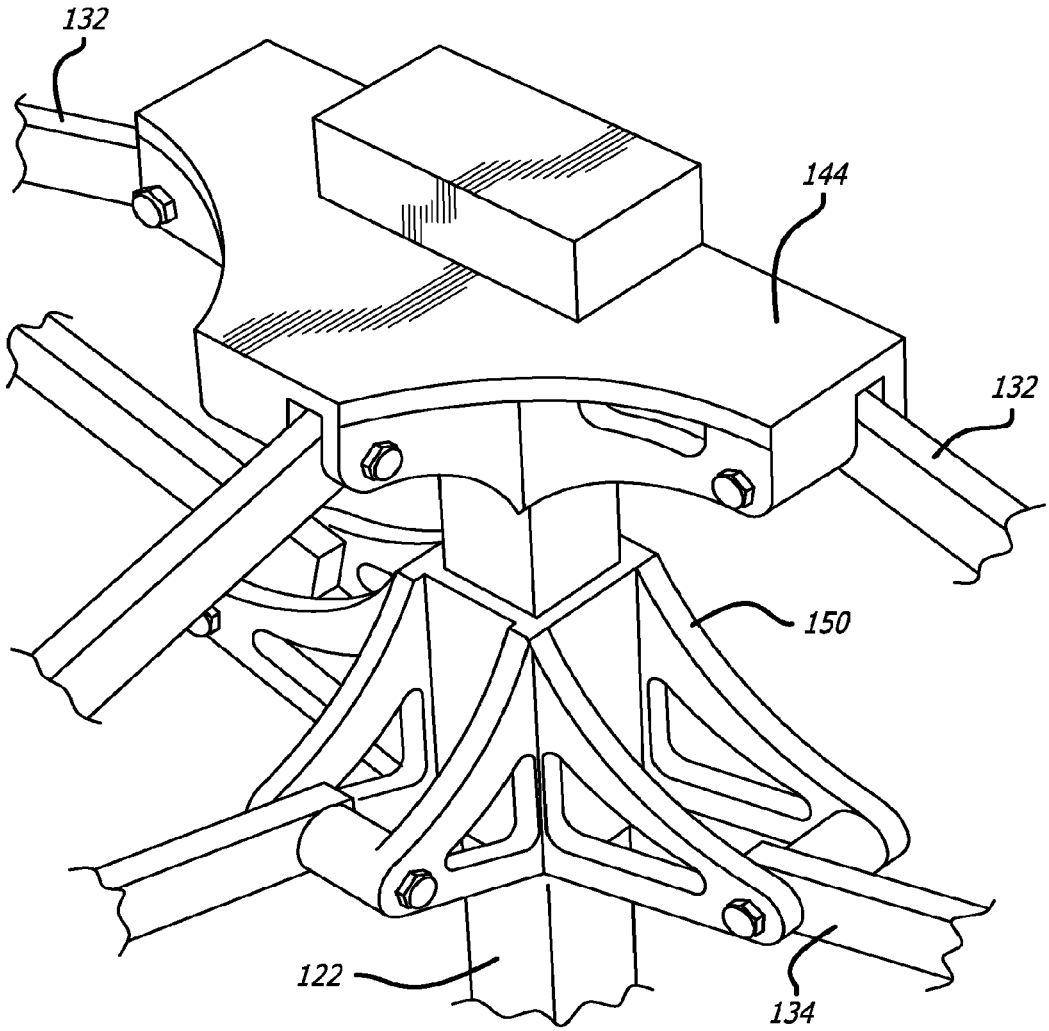
FIG. 20 is an enlarged view of an upper leg of the modular folding table of FIG. 19, showing the upper leg pivotally connected to the upper ends of three link members of the truss framework, and a slider mounted on the leg pivotally connected to the lower ends of three link member of the truss framework.
Figure 21:
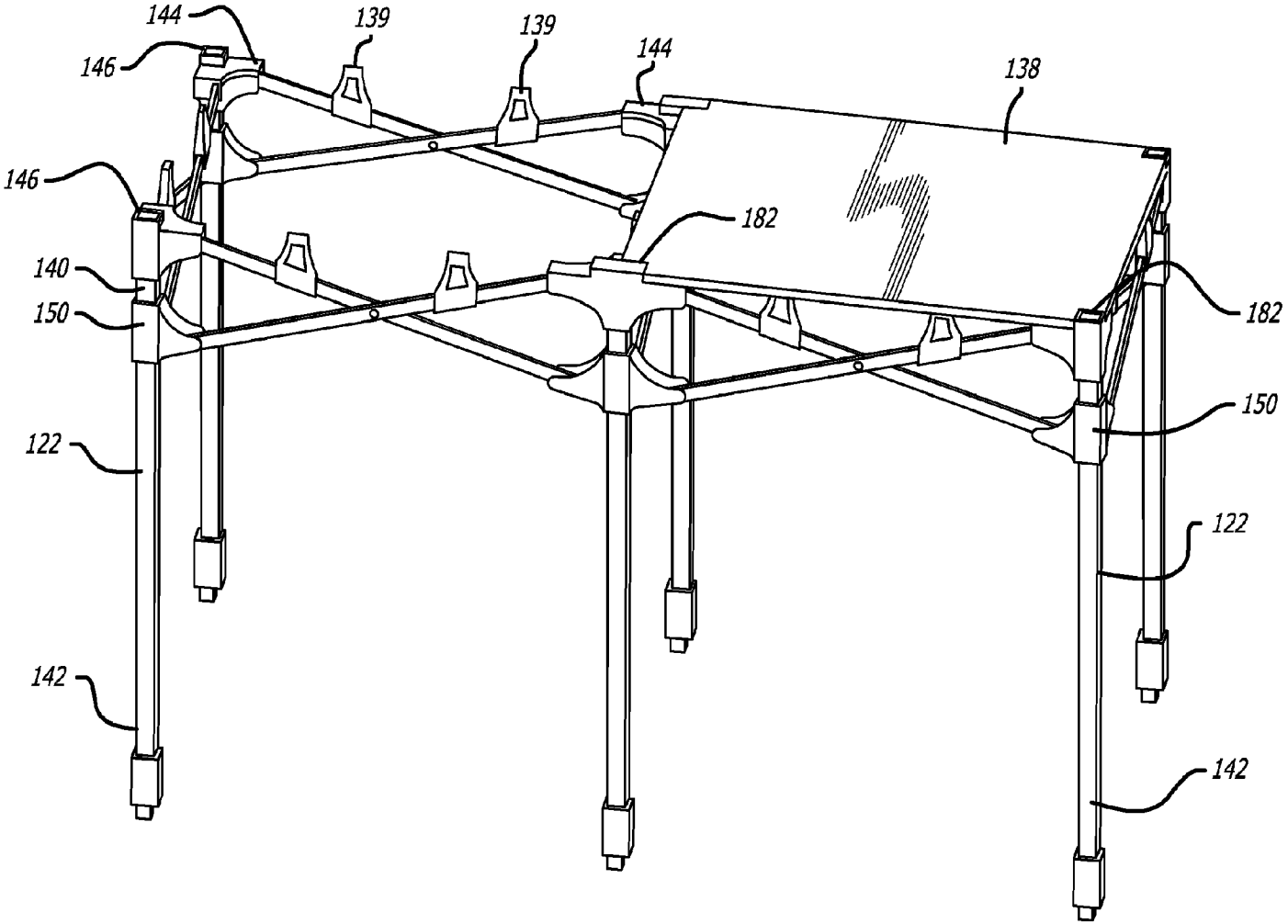
FIG. 21 is a perspective view of the modular folding table of FIG. 19 in an assembled, extended configuration.

Referring to FIGS. 19-21, in which like reference numbers denote like elements, in a second embodiment of the modular folding table according to the present invention, the modular folding table 120 includes a plurality of legs 122, and a truss framework 124 connected to each of the legs. The truss framework includes a plurality of truss pairs of link members 126, with each of the truss pairs including first link members 128 and second link members 130, each having upper ends 132 and lower ends 134. A plurality of table tops 138 can be removably disposed on the upper ends of the legs. The first and second link members are pivotally connected together at a midpoint 136 between the upper and lower ends in a scissors configuration so as to be extendable horizontally from a collapsed configuration to an extended configuration. Each of the first and second link members includes a table top support bracket 139 mounted between the midpoint and the upper ends of the link members for contacting and supporting the table top when it is placed on the upper ends of the legs.

Each of the legs has an upper end 140 and a lower end 142, and the upper end of the first link member is pivotally connected to the upper end of one of the legs, and the lower end of the first link member is slidably connected to an adjacent one of the legs. Likewise, the upper end of the second link member is pivotally connected to the upper end of one of the legs, and the lower end of the first link member is slidably connected to an adjacent one of the legs.

The upper ends of the legs include a pair of lands 144 for supporting the plurality of table tops. Each leg preferably includes a slider member 150 slidably mounted to the leg for slidably connecting the lower ends of the first and second link members to corresponding ones of the legs. In a presently preferred aspect, at least one of the legs includes latch means for latching at least one of the slider members in a fixed position on the leg. Each of the legs preferably includes a telescoping foot extension, and each of the legs preferably includes means, such as a spring loaded detent pin and corresponding latching hole in the leg, for example, for fixing the foot extension in a retracted position, and means, such as another spring loaded detent pin and corresponding latching hole in the leg, for fixing the foot extension in an extended position. The table top preferably includes a plurality of notches 182 at corner locations corresponding to the plurality of legs when the legs and the truss framework are in the extended configuration.

Figure 22:
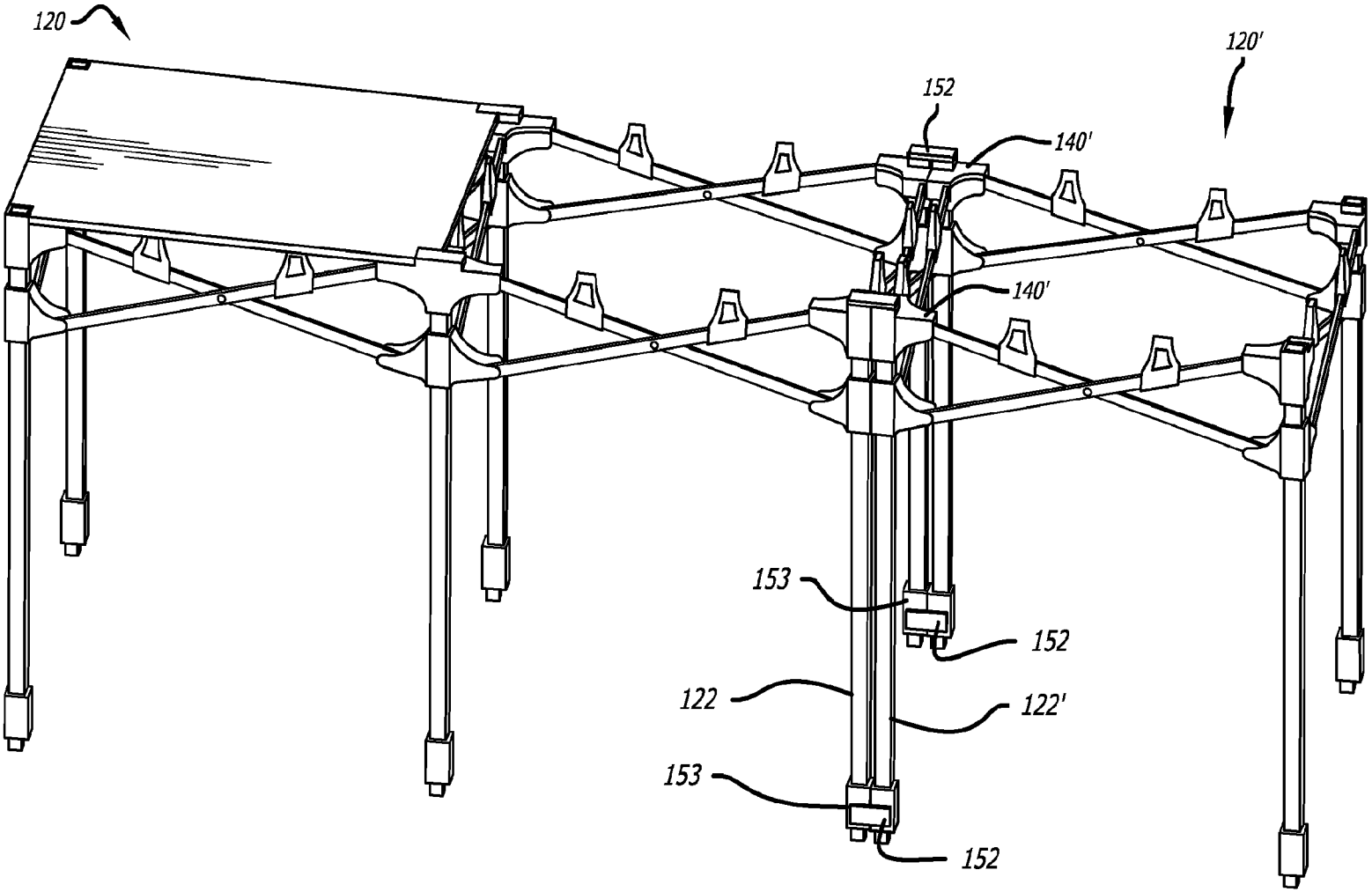
FIG. 22 is a perspective view of the modular folding table of FIG. 19 in an assembled, extended configuration, and connected by upper and lower leg connector brackets to a second modular folding table.
Figure 23:
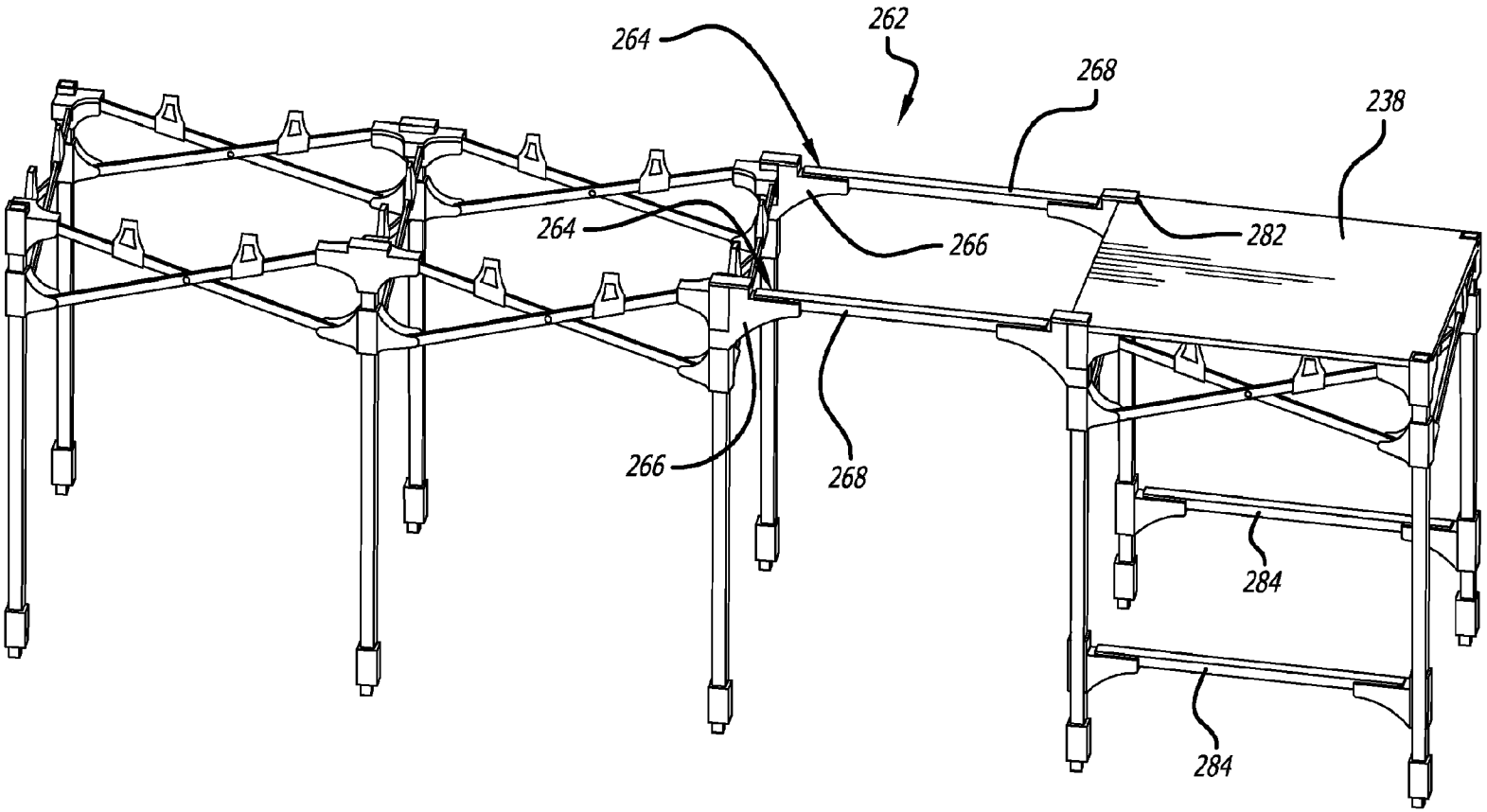
FIG. 23 is a perspective view of a third embodiment of the modular folding table including table top support bars, shown in an assembled, extended configuration, with a variant of the second embodiment connected by table top support bars to a second modular folding table, which is a variant of the first embodiment, including shelf support arms.
Figure 24:
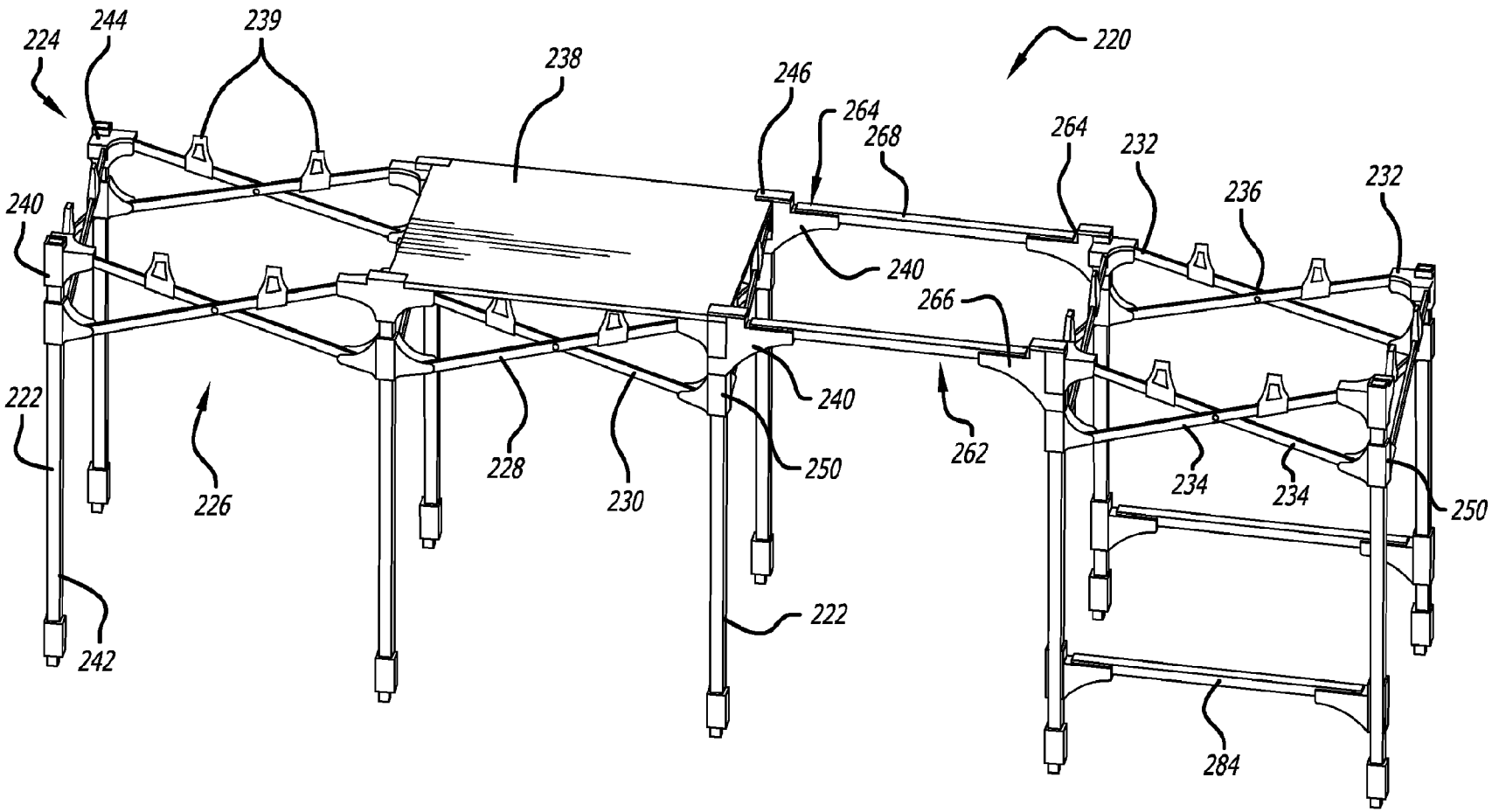
FIG. 24 is another perspective view of the modular folding table of FIG. 23.
Figure 25:
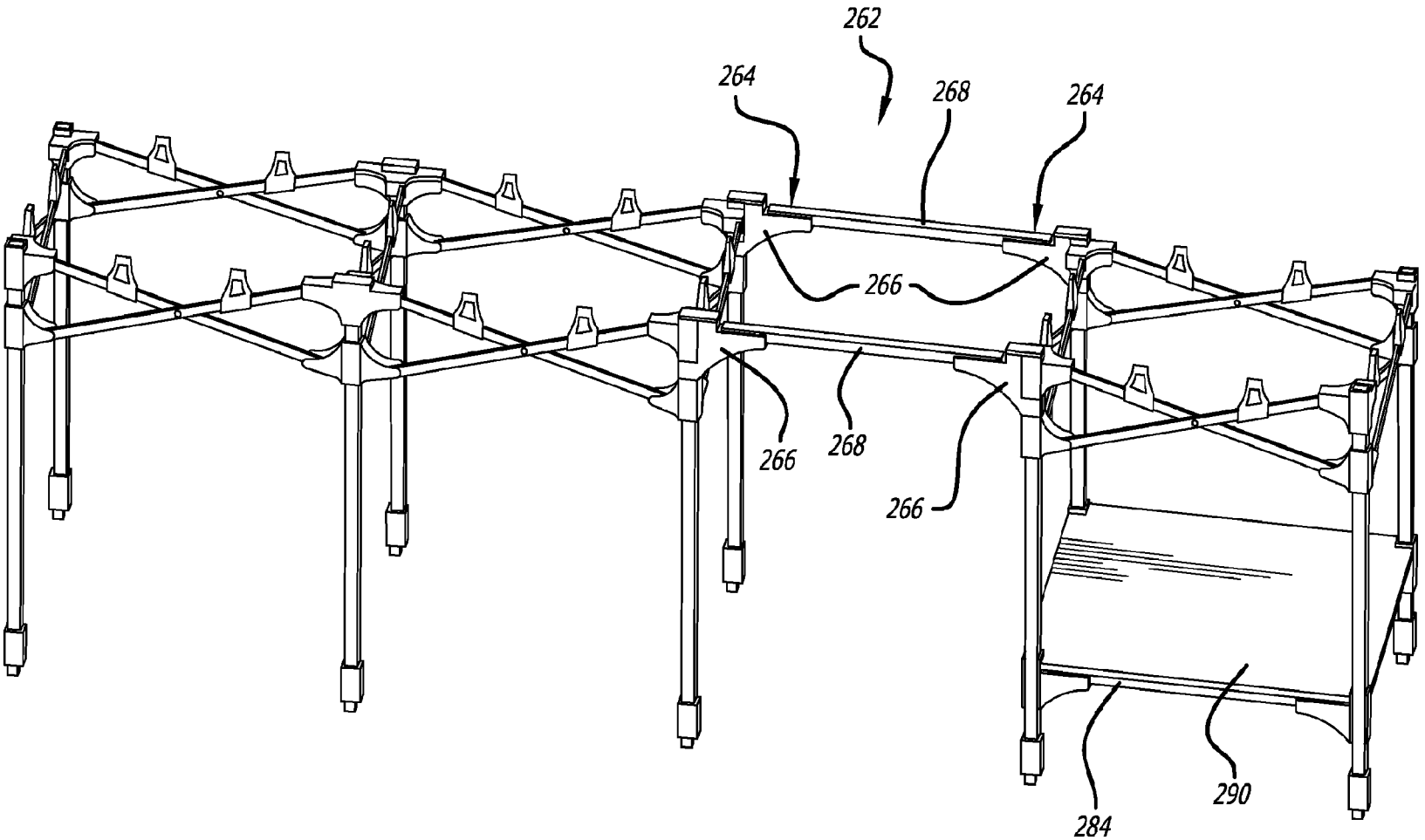
FIG. 25 is a perspective view of the modular folding table of FIG. 23, including a lower shelf installed on shelf support arms.
Figure 30:
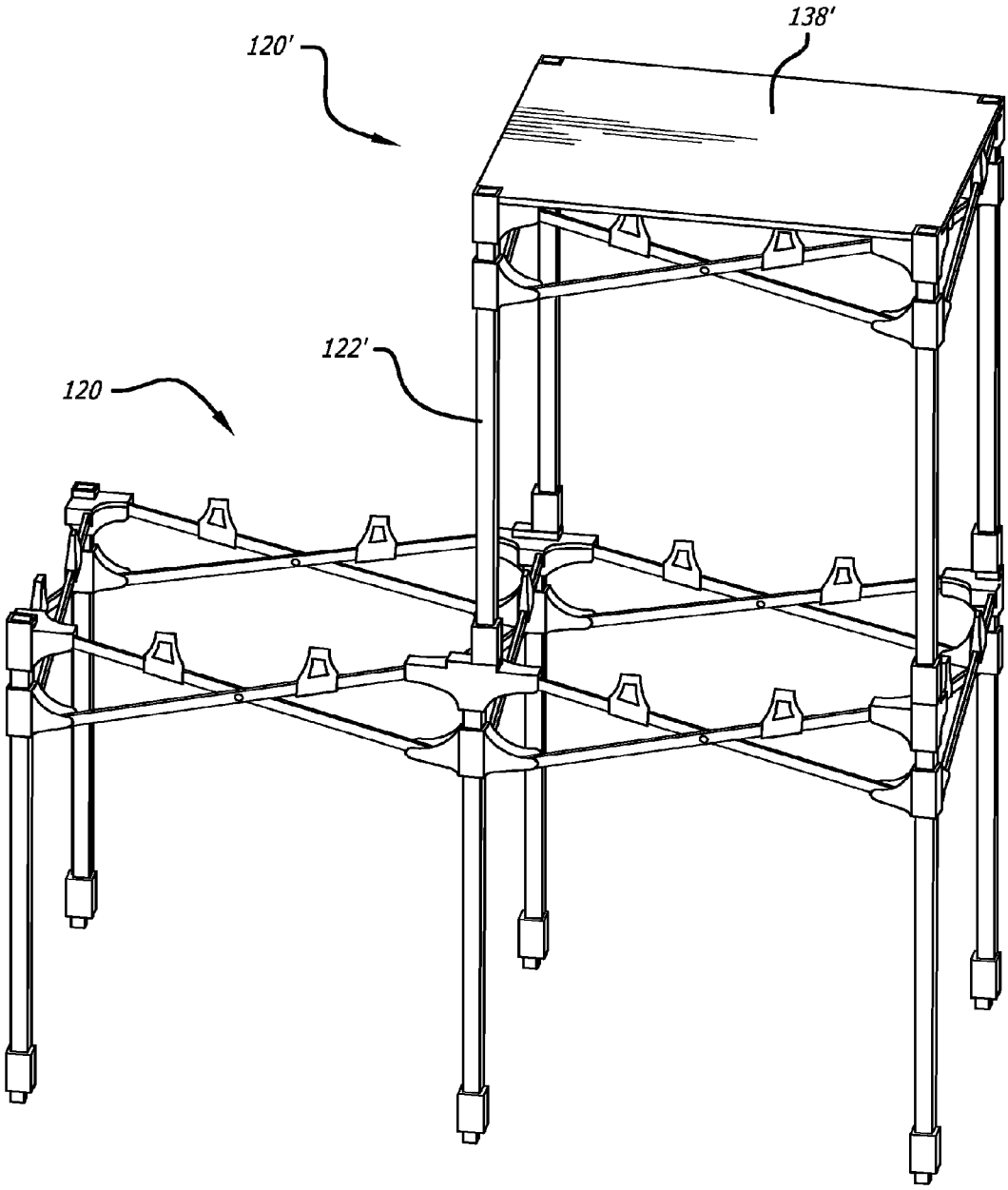
FIG. 30 is a perspective view of a lower modular folding table of FIG. 19 with a second modular folding table vertically stacked on top, with the legs of the second modular folding table connected in a portion of the upper recesses of the legs of the lower modular folding table.
Figure 31:
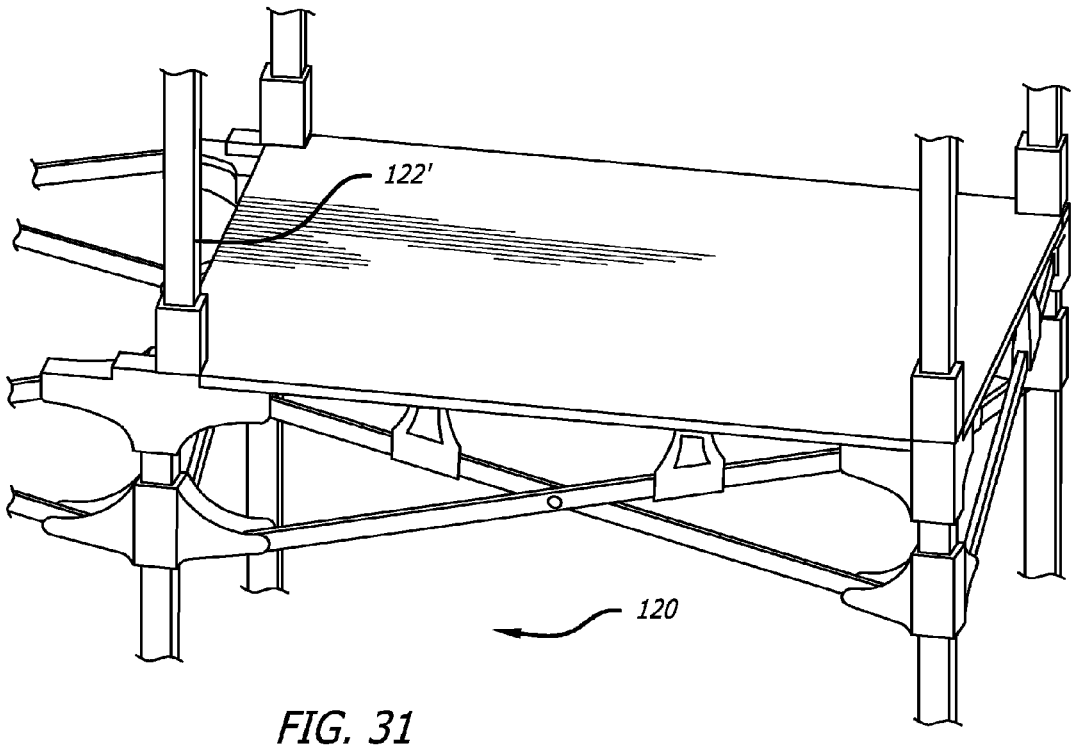
FIG. 31 is an enlarged view of a portion of the view of FIG. 30, showing the lower modular folding table of FIG. 19 with a second modular folding table vertically stacked on top, with the legs of the second modular folding table connected in a portion of the upper recesses of the legs of the lower modular folding table.
Figure 32:
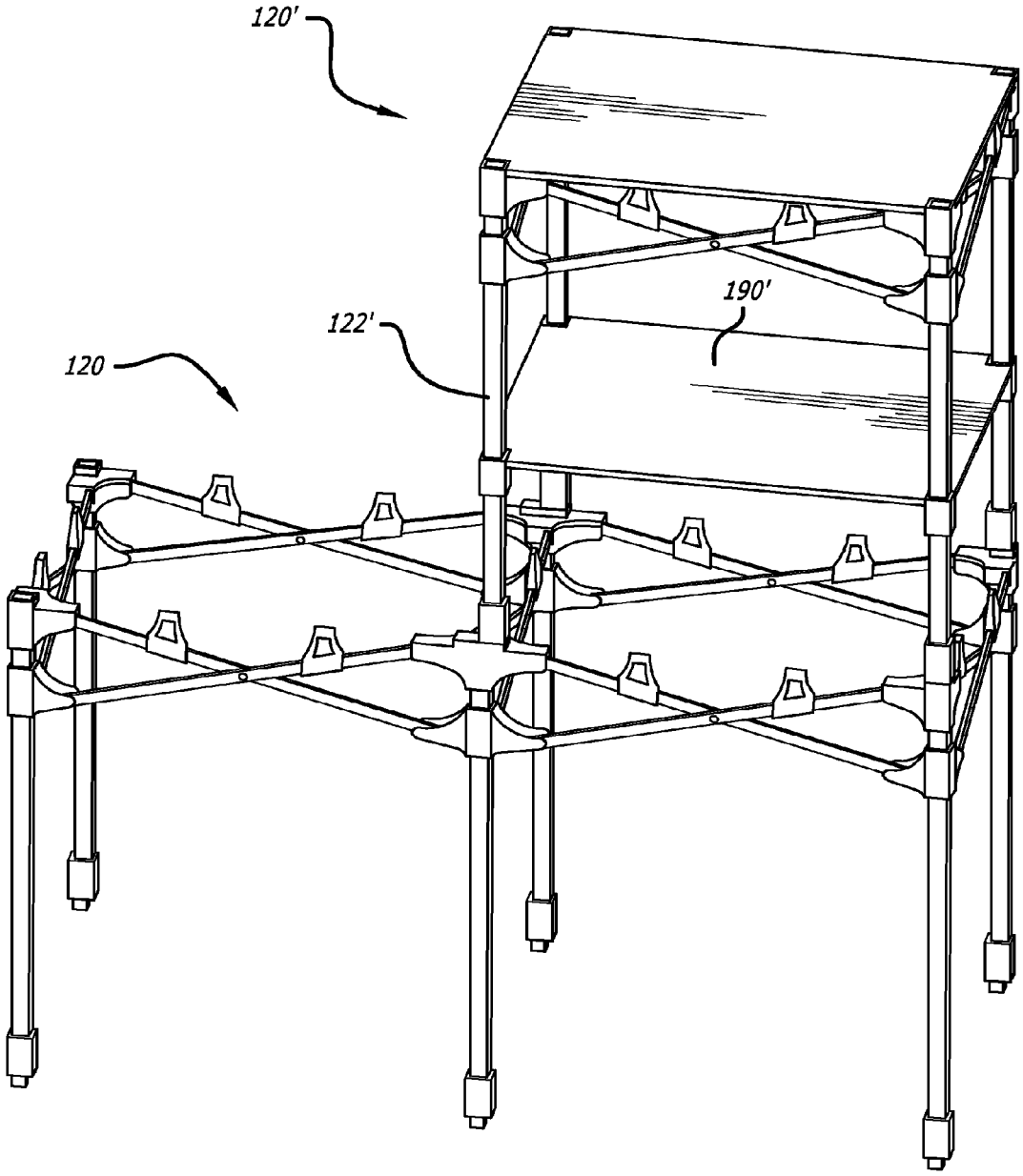
FIG. 32 is a perspective view of a lower modular folding table of FIG. 19 with a second modular folding table vertically stacked on top, with the legs of the second modular folding table connected in a portion of the upper recesses of the legs of the lower modular folding table, with a lower shelf mounted on lower shelf support arms of the upper, second modular folding table.

As is illustrated in FIG. 22, an upper leg connector bracket 148, such as a two plug cap, for example, may also be provided for connecting a recess of one of the legs of the modular folding table to an adjacent recess in an upper end 140' of a leg 122' of a second modular folding table 120' for connecting the modular folding table and the second modular folding table together. As is illustrated in FIG. 22, a lower leg connector bracket 152, such as a two plug cap, for example, may also be provided for connecting sockets of female connector brackets 153 attached to the lower leg portions may also be provided for connecting one of the legs of the modular folding table to an adjacent leg 122' of a second modular folding table 120' for connecting the modular folding table and the second modular folding table together. In another presently preferred aspect, the upper ends of the legs include a recess 146 for receiving a lower end of a leg 122' of a second modular folding table 120', for stacking the second modular folding table on the modular folding table, as is illustrated in FIGS. 30-32.

As described above, in another presently preferred aspect, the modular folding table may be provided with shelf support arms connected between a pair of legs, so that a lower shelf may thus be removably disposed on the shelf support arms. The lower shelf typically includes a plurality of segments hingedly connected together so as to be foldable, such as at least three segments connected together by at least two hinges, for example. The hinges of the shelf typically also each include a pair of flat plate portions connected to adjoining segments of the lower shelf, and the pair of flat plate portions are pivotally connected together by a pivot pin. Preferably the flat plate portions of at least one of the hinges are connected to the pivot pin by right angle members extending transversely from the flat portions, so that the lower shelf segments are foldable. In another preferred aspect, the lower shelf includes a plurality of notches at corner locations corresponding to the plurality of legs when the legs and the truss framework are in the extended configuration.

In a third preferred embodiment, in which like reference numbers denote like elements, as is illustrated in FIGS. 23-28, the invention provides for a modular folding table 220 including a plurality of legs 222, and a truss framework 224 connected to each of the legs. The truss framework includes a plurality of truss pairs of link members 226, with each of the truss pairs including first link members 228 and second link members 230, each having upper ends 232 and lower ends 234. A plurality of table tops 238 can be removably disposed on the upper ends of the legs. The first and second link members are pivotally connected together at a midpoint 236 between the upper and lower ends in a scissors configuration so as to be extendable horizontally from a collapsed configuration to an extended configuration. Each of the first and second link members includes a table top support bracket 239 mounted between the midpoint and the upper ends of the link members for contacting and supporting the table top when it is placed on the upper ends of the legs.

Each of the legs has an upper end 240 and a lower end 242, and the upper end of the first link member is pivotally connected to the upper end of one of the legs, and the lower end of the first link member is slidably connected to an adjacent one of the legs. Likewise, the upper end of the second link member is pivotally connected to the upper end of one of the legs, and the lower end of the first link member is slidably connected to an adjacent one of the legs.

The upper ends of the legs include a pair of lands 244 for supporting the plurality of table tops. Each leg preferably includes a slider member 250 slidably mounted to the leg for slidably connecting the lower ends of the first and second link members to corresponding ones of the legs. As described above, in a presently preferred aspect, at least one of the legs includes latch means for latching at least one of the slider members in a fixed position on the leg. Each of the legs preferably includes a telescoping foot extension, and each of the legs preferably includes means, such as a spring loaded detent pin and corresponding latching hole in the leg, for example, for fixing the foot extension in a retracted position, and means, such as another spring loaded detent pin and corresponding latching hole in the leg, for fixing the foot extension in an extended position. The table top preferably includes a plurality of notches 282 at corner locations corresponding to the plurality of legs when the legs and the truss framework are in the extended configuration.

Figure 26:
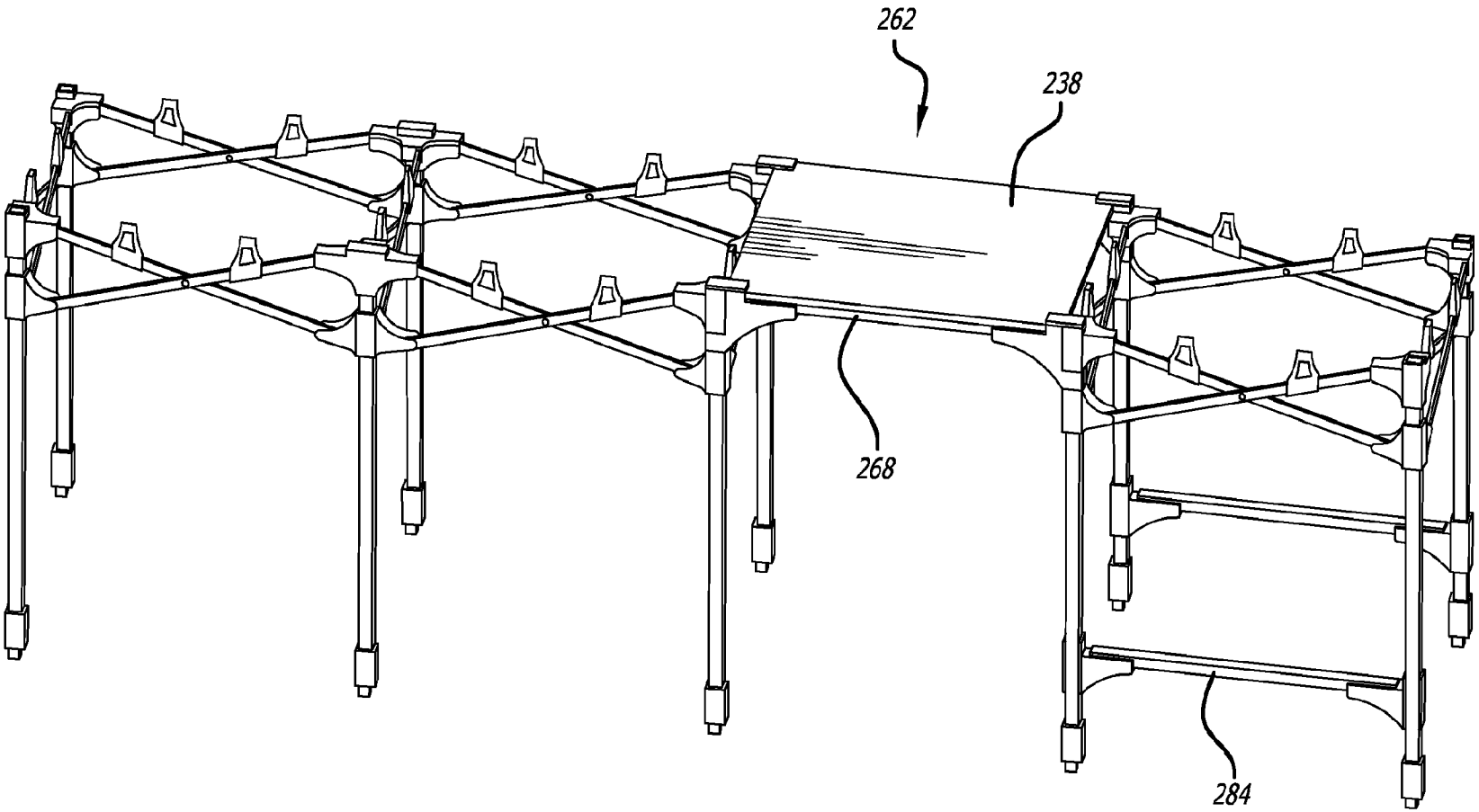
FIG. 26 is another perspective view of the modular folding table of FIG. 23, showing a table top placed on the table top support bars.
Figure 27:
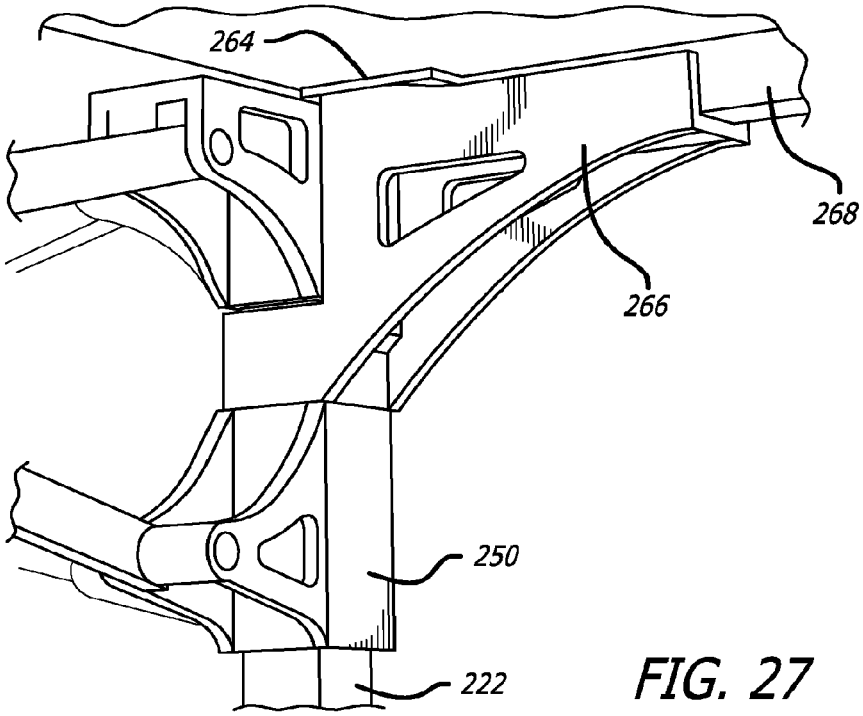
FIG. 27 is a perspective view of an underside of a table top and an upper end of a leg of the modular folding table of FIG. 26, showing a socket for receiving a table top support bar.
Figure 28:
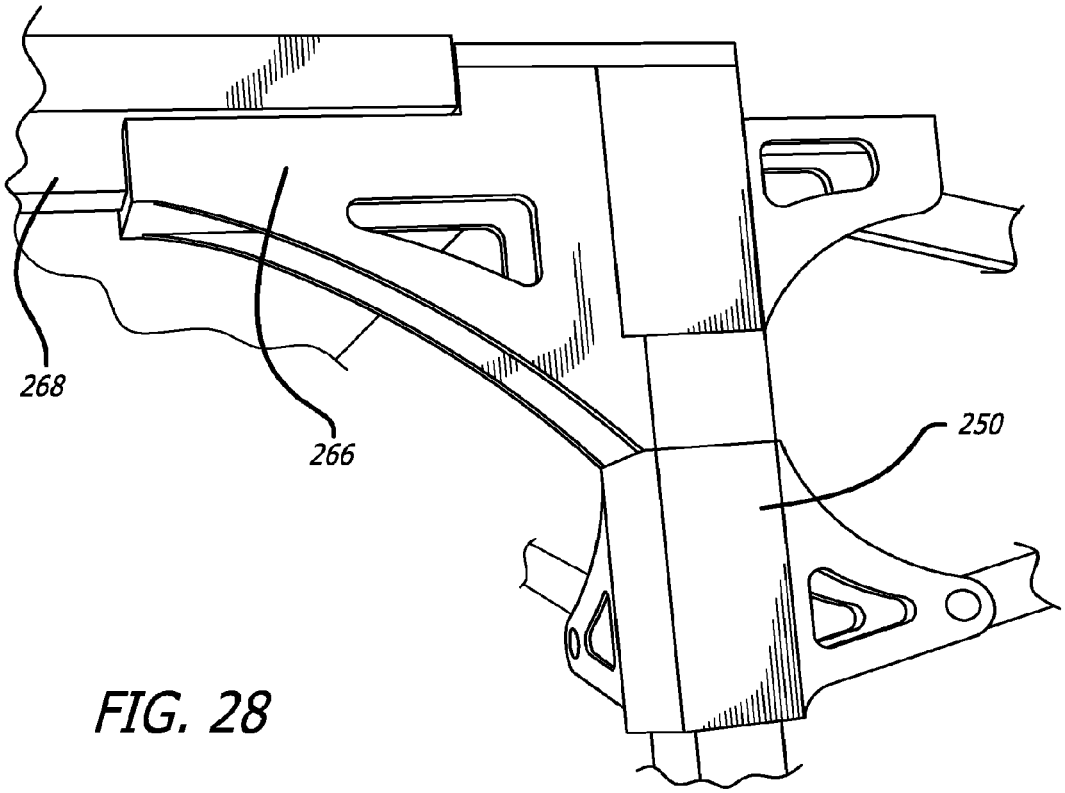
FIG. 28 is another perspective view of a table top and an upper end of a leg of the modular folding table of FIG. 26, showing a socket for receiving a table top support bar.

The upper ends 240 of the legs 222 along at least one side 262 of the modular folding table, and preferably along opposing sides, include a land 264 for supporting a table top, and a socket 266 for receiving a table top support bar 268 for supporting the table top, as is illustrated in FIG. 26, for example.

Referring to FIGS. 23-26, in another presently preferred aspect, the modular folding table may be provided with at least two shelf support arms 284 each having a first end and a second end connected between a pair of legs, so that a lower shelf 290 may thus be removably disposed on the shelf support arms. The lower shelf typically includes a plurality of segments hingedly connected together so as to be foldable, such as at least three segments connected together by at least two hinges, for example. The hinges of the shelf typically also each include a pair of flat plate portions connected to adjoining segments of the lower shelf, and the pair of flat plate portions are pivotally connected together by a pivot pin. Preferably the flat plate portions of at least one of the hinges are connected to the pivot pin by right angle members extending transversely from the flat portions, so that the lower shelf segments are foldable. In another preferred aspect, the lower shelf includes a plurality of notches at corner locations corresponding to the plurality of legs when the legs and the truss framework are in the extended configuration.

It will be appreciated that the present invention accordingly provides for a modular folding table with one or more braces added to the truss framework for supporting a table top, with legs having upper portions with recesses for receiving the legs of one or more other modular tables, so that the modular folding table of the invention is stackable. The present invention also provides for a modular folding table with brackets allowing the addition of one or more leaves of a table top to expand the table without adding base frame sections. In addition, shelves can be fixed to the legs with brackets, and the modular folding table of the invention is connectable at the base of the legs by brackets that allow two or more tables to connect with a two plug cap.

It will be apparent from the foregoing that, while particular forms of the invention have been illustrated and described, various modifications can be made without departing from the spirit and scope of the invention. Accordingly, it is not intended that the invention be limited, except as by the appended claims.

I claim:

1. A modular folding table, comprising:

a plurality of vertically disposed legs, each of said legs having an upper end and a lower end, each said upper end of said legs including a pair of lands;

a truss framework connected to each of said legs, said truss framework including a plurality of truss pairs of link members, each of said truss pairs including first and second link members having upper and lower ends, said first and second link members being pivotally connected together in a scissors configuration between adjacent ones of said legs, said upper end of said first link member being pivotally connected to one of said legs, said lower end of said first link member being slidably connected to an adjacent one of said legs, said upper end of said second link member being pivotally connected to one of said legs, said lower end of said second link member being slidably connected to an adjacent one of said legs, said first and second link members being extendable horizontally from a collapsed configuration to an extended configuration, and a table top support bracket mounted to each of said first and second link members; and a plurality of table tops removably disposed on said pairs of lands of the upper ends of said legs and said table top support brackets in said extended configuration, two of said plurality of table tops being removably disposed on one land of one said pair of lands of one of said upper ends of said legs.

2. The modular folding table of claim 1, wherein said upper ends of said legs include a recess for receiving a lower end of a leg of a second modular folding table for vertically stacking the second modular folding table on the modular folding table.

3. The modular folding table of claim 2, further comprising an upper leg connector bracket configured to horizontally connect one said recess of one of the legs of the modular folding table to an adjacent recess in an upper end of a leg of a second modular folding table to horizontally connect the modular folding table and the second modular folding table together.

4. The modular folding table of claim 1, further comprising a first female connector bracket including a socket attached to a lower portion of one of said legs of the modular folding table, and a second female connector bracket including a socket attached to a lower portion of an adjacent leg of a second modular folding table, and a lower leg connector bracket configured to horizontally connect said first female connector bracket of said one of said legs of the modular folding table to said second female connector bracket of said adjacent leg of a second modular folding table.

5. The modular folding table of claim 1, further comprising a plurality of slider members slidably mounted to each of said plurality of vertically disposed legs, respectively, and said lower ends of said link members being connected to corresponding slider members, respectively, for slidably connecting adjacent second link members of adjacent sides to corresponding vertically disposed legs, respectively, and wherein at least one of said legs includes latch means for latching at least one of said slider members in a fixed position on said at least one of said legs.

6. The modular folding table of claim 1, wherein each of said legs further comprises a telescoping foot extension.

7. The modular folding table of claim 6, wherein each of said legs includes means for fixing said foot extension in a retracted position.

8. The modular folding table of claim 6, wherein each of said legs includes means for fixing said foot extension in an extended position.

9. The modular folding table of claim 1, wherein said table top comprises a plurality of segments connected together by at least one hinge so as to be foldable.

10. The modular folding table of claim 9, wherein said table top comprises at least three segments connected together by first and second hinges, said first and second hinges each including corresponding first and second pairs of flat plate portions connected to adjoining segments of the table top, each of said first and second pairs of flat plate portions being pivotally connected together by first and second pivot pins, respectively, and said first and second pivot pins being connected to said first and second hinges at different distances from said corresponding first and second pairs of flat plate portions so that said table top is foldable.

11. The modular folding table of claim 1, wherein said table top comprises a plurality of notches at corner locations corresponding to said plurality of legs when said legs and said truss framework are in said extended configuration.

12. The modular folding table of claim 1, further comprising at least two shelf support arms each having first and second ends, and means for removably attaching said first and second ends between adjacent legs for supporting said lower shelf.

13. The modular folding table of claim 12, further comprising a lower shelf disposed on said at least two shelf support arms.

14. The modular folding table of claim 13, wherein said lower shelf comprises a plurality of segments hingedly connected together so as to be foldable.

15. The modular folding table of claim 14, wherein said lower shelf comprises at least three segments connected together by first and second hinges, said first and second hinges each including corresponding first and second pairs of flat plate portions connected to adjoining segments of the lower shelf, each of said first and second pairs of flat plate portions being pivotally connected together by first and second pivot pins, respectively, and said first and second pivot pins being connected to said first and second hinges at different distances from said corresponding first and second pairs of flat plate portions, so that said lower shelf is foldable.

16. The modular folding table of claim 13, wherein said lower shelf comprises a plurality of notches at corner locations corresponding to said plurality of legs when said legs and said truss framework are in said extended configuration.

17. A modular folding table, comprising:

a plurality of vertically disposed legs, said plurality of vertically disposed legs having corresponding upper ends and lower ends, respectively, and said upper ends of said plurality of vertically disposed legs including pairs of adjacent lands, respectively;

a truss framework connected to each of said plurality of vertically disposed legs, said truss framework including a plurality of truss pairs of link members, each of said truss pairs including first and second link members having upper and lower ends, said first and second link members being pivotally connected together in a scissors configuration between adjacent ones of said plurality of vertically disposed legs, said upper end of said first link member being pivotally connected to one of said plurality of vertically disposed legs, said lower end of said first link member being slidably connected to an adjacent one of said plurality of vertically disposed legs, said upper end of said second link member being pivotally connected to one of said plurality of vertically disposed legs, said lower end of said second link member being slidably connected to an adjacent one of said plurality of vertically disposed legs, said first and second link members being extendable horizontally from a collapsed configuration to an extended configuration, and a table top support bracket mounted to each of said first and second link members; and a plurality of table tops removably disposed on said pairs of adjacent lands of the upper ends of said plurality of vertically disposed legs and said table top support brackets in said extended configuration, a first one of said plurality of table tops being removably disposed on a first land of one of said pairs of adjacent lands of a first corresponding one of said plurality of vertically disposed legs and on an adjacent second land of one of said pairs of adjacent lands of an adjacent corresponding one of said plurality of vertically disposed legs, and a second one of said plurality of table tops being removably disposed on said first land of one of said pairs of adjacent lands of said first corresponding one of said plurality of vertically disposed legs and on said adjacent second land of one of said pairs of adjacent lands of said second adjacent one of said plurality of vertically disposed legs.

* * * * *